US011480038B2

(12) United States Patent
Eitschberger

(10) Patent No.: US 11,480,038 B2
(45) Date of Patent: Oct. 25, 2022

(54) MODULAR PERFORATING GUN SYSTEM

(71) Applicant: DynaEnergetics Europe GmbH, Troisdorf (DE)

(72) Inventor: Christian Eitschberger, Munich (DE)

(73) Assignee: DynaEnergetics Europe GmbH, Troisdorf (DE)

( * ) Notice: Subject to any disclaimer, the term of this patent is extended or adjusted under 35 U.S.C. 154(b) by 0 days.

(21) Appl. No.: 17/123,972

(22) Filed: Dec. 16, 2020

(65) Prior Publication Data

US 2021/0277752 A1 Sep. 9, 2021

Related U.S. Application Data

(60) Provisional application No. 63/031,339, filed on May 28, 2020, provisional application No. 62/949,016, filed on Dec. 17, 2019.

(51) Int. Cl.

| | |
|---|---|
| ***E21B 43/117*** | (2006.01) |
| ***E21B 43/1185*** | (2006.01) |
| ***E21B 43/119*** | (2006.01) |
| ***F42D 1/04*** | (2006.01) |

(52) U.S. Cl.

CPC ..... *E21B 43/117* (2013.01); *E21B 43/119* (2013.01); *E21B 43/1185* (2013.01); *F42D 1/043* (2013.01)

(58) Field of Classification Search

CPC .. E21B 43/117; E21B 43/1185; E21B 43/119; F42D 1/043

See application file for complete search history.

(56) References Cited

U.S. PATENT DOCUMENTS

| | | | |
|---|---|---|---|
| 2,062,974 | A | 12/1936 | Lane |
| 2,142,572 | A | 1/1939 | Metzner |
| 2,216,359 | A | 10/1940 | Spencer |
| 2,228,873 | A | 1/1941 | Hardt et al. |

(Continued)

FOREIGN PATENT DOCUMENTS

| | | | |
|---|---|---|---|
| CA | 2003166 | A1 | 5/1991 |
| CA | 2821506 | A1 | 1/2015 |

(Continued)

OTHER PUBLICATIONS

WIPO, International Search Report for International Application No. PCT/CA2014/050673, dated Oct. 9, 2014, 3 pgs.

(Continued)

*Primary Examiner* — Daniel P Stephenson
(74) *Attorney, Agent, or Firm* — Moyles IP, LLC

(57) ABSTRACT

A modular, stackable charge holder for a perforating gun assembly. The charge holder may include a retention socket for locking a detonating cord in place, and a male connector end and a female connector end for connecting to other modular component(s). The retention socket may include oppositely disposed retention arms, each having a shaped sidewall portion and a corresponding flange extending transversely from a top section of the retention arm. The male and female connector ends may respectively include a phasing protrusion and a phasing hole arranged to facilitate various phase angles between components, and a centrally oriented knob connector and a central bore adapted to interconnect.

19 Claims, 10 Drawing Sheets

(56) References Cited

U.S. PATENT DOCUMENTS 2,264,450 A 12/1941 Mounce
2,326,406 A 8/1943 Lloyd
2,358,466 A 9/1944 Miller
2,418,486 A 4/1947 Smylie
2,439,394 A 4/1948 Lanzalotti et al.
2,543,814 A 3/1951 Thompson et al.
2,598,651 A 5/1952 Spencer
2,637,402 A 5/1953 Baker et al.
2,640,547 A 6/1953 Baker et al.
2,649,046 A 8/1953 Oliver
2,655,993 A 10/1953 Lloyd
2,692,023 A 10/1954 Conrad
2,708,408 A 5/1955 Sweetman
2,734,456 A 2/1956 Sweetman
2,742,856 A 4/1956 Fieser et al.
2,742,857 A 4/1956 Turechek
2,761,384 A 9/1956 Sweetman
2,766,690 A 10/1956 Lebourg
2,785,631 A 3/1957 Blanchard
2,873,675 A 2/1959 Lebourg
2,889,775 A 6/1959 Owen
2,906,339 A 9/1959 Griffin
2,946,283 A 7/1960 Udry
2,982,210 A 5/1961 Andrew et al.
2,996,591 A 8/1961 Thomas
3,013,491 A 12/1961 Poulter
3,040,659 A 6/1962 Mcculleugh
3,071,072 A 1/1963 Castel et al.
3,080,005 A 3/1963 Porter
RE25,407 E 6/1963 Lebourg
3,125,024 A 3/1964 Hicks et al.
3,128,702 A 4/1964 Christopher
3,158,680 A 11/1964 Lovitt et al.
3,170,400 A 2/1965 Nelson
3,173,992 A 3/1965 Boop
RE25,846 E 8/1965 Campbell
3,209,692 A 10/1965 George
3,211,093 A 10/1965 Mccullough et al.
3,246,707 A 4/1966 Bell
3,264,989 A 8/1966 Rucker
3,264,994 A 8/1966 Kurt
3,320,884 A 5/1967 Kowalick et al.
3,327,792 A 6/1967 Boop
3,357,355 A 12/1967 Roush
3,374,735 A 3/1968 Moore
3,414,071 A 12/1968 Alberts
3,415,321 A 12/1968 Venghiattis
3,498,376 A 3/1970 Sizer et al.
3,504,723 A 4/1970 Cushman et al.
3,565,188 A 2/1971 Hakala
3,621,916 A 11/1971 Smith, Jr.
3,650,212 A 3/1972 Bauer
3,659,658 A 5/1972 Brieger
3,669,190 A 6/1972 Sizer et al.
3,731,626 A 5/1973 Grayson
3,859,921 A 1/1975 Stephenson
3,892,455 A 7/1975 Sotolongo
4,007,790 A 2/1977 Henning
4,007,796 A 2/1977 Boop
4,024,817 A 5/1977 Calder, Jr et al.
4,034,673 A 7/1977 Schneider, Jr.
4,039,239 A 8/1977 Cobaugh et al.
4,058,061 A 11/1977 Mansur, Jr. et al.
4,071,096 A 1/1978 Dines
4,080,898 A 3/1978 Gieske
4,080,902 A 3/1978 Goddard et al.
4,084,147 A 4/1978 Mlyniec et al.
4,085,397 A 4/1978 Yagher
4,107,453 A 8/1978 Erixon
4,132,171 A 1/1979 Pawlak et al.
4,140,188 A 2/1979 Vann
4,172,421 A 10/1979 Regalbuto
4,182,216 A 1/1980 DeCaro
4,191,265 A 3/1980 Bosse-Platiere
4,193,460 A 3/1980 Gilbert
4,208,966 A 6/1980 Hart
4,216,721 A 8/1980 Marziano et al.
4,220,087 A 9/1980 Posson
4,261,263 A 4/1981 Coultas et al.
4,266,613 A 5/1981 Boop
4,284,235 A 8/1981 Diermayer et al.
4,290,486 A 9/1981 Regalbuto
4,306,628 A 12/1981 Adams, Jr. et al.
4,312,273 A 1/1982 Camp
4,319,526 A 3/1982 DerMott
4,345,646 A 8/1982 Terrell
4,346,954 A 8/1982 Appling
4,363,529 A 12/1982 Loose
4,387,773 A 6/1983 McPhee
4,393,946 A 7/1983 Pottier et al.
4,411,491 A 10/1983 Larkin et al.
4,430,939 A 2/1984 Harrold
4,455,941 A 6/1984 Walker et al.
4,479,556 A 10/1984 Stout et al.
4,485,741 A 12/1984 Moore et al.
4,491,185 A 1/1985 McClure
4,496,008 A 1/1985 Pottier et al.
4,512,418 A 4/1985 Regalbuto et al.
4,519,313 A 5/1985 Leidel
4,523,649 A 6/1985 Stout
4,523,650 A 6/1985 Sehnert et al.
4,534,423 A 8/1985 Regalbuto
4,541,486 A 9/1985 Wetzel et al.
4,574,892 A 3/1986 Grigar et al.
4,576,233 A 3/1986 George
4,583,602 A 4/1986 Ayers
4,598,775 A 7/1986 Vann et al.
4,609,057 A 9/1986 Walker et al.
4,619,320 A 10/1986 Adnyana et al.
4,621,396 A 11/1986 Walker et al.
4,635,734 A 1/1987 Donovan et al.
4,637,478 A 1/1987 George
4,640,354 A 2/1987 Boisson
4,640,370 A 2/1987 Wetzel
4,643,097 A 2/1987 Chawla et al.
4,650,009 A 3/1987 McClure et al.
4,655,138 A 4/1987 Regalbuto et al.
4,657,089 A 4/1987 Stout
4,660,910 A 4/1987 Sharp et al.
4,670,729 A 6/1987 Oh
4,744,424 A 5/1988 Lendermon et al.
4,747,201 A 5/1988 Donovan et al.
4,753,170 A 6/1988 Regalbuto et al.
4,753,301 A 6/1988 Berry
4,756,363 A 7/1988 Lanmon et al.
4,762,067 A 8/1988 Barker et al.
4,766,813 A 8/1988 Winter et al.
4,776,393 A 10/1988 Forehand et al.
4,790,383 A 12/1988 Savage et al.
4,796,708 A 1/1989 Lembcke
4,800,815 A 1/1989 Appledorn et al.
4,817,531 A 4/1989 Walker et al.
4,832,134 A 5/1989 Gill
4,850,438 A 7/1989 Regalbuto
4,852,494 A 8/1989 Williams
4,869,171 A 9/1989 Abouav
4,884,506 A 12/1989 Guerreri
4,889,183 A 12/1989 Sommers et al.
4,998,478 A 3/1991 Beck
5,001,981 A 3/1991 Shaw
5,006,833 A 4/1991 Marlowe et al.
5,007,486 A 4/1991 Ricles
5,010,821 A 4/1991 Blain
5,027,708 A 7/1991 Gonzalez et al.
5,033,553 A 7/1991 Miszewski et al.
5,038,682 A 8/1991 Marsden
5,040,619 A 8/1991 Jordan et al.
5,042,594 A 8/1991 Gonzalez et al.
5,052,489 A 10/1991 Carisella et al.
5,060,573 A 10/1991 Montgomery et al.
5,070,788 A 12/1991 Carisella et al.
5,083,929 A 1/1992 Dalton
5,088,413 A 2/1992 Huber
5,090,324 A 2/1992 Bocker et al.

(56) References Cited

U.S. PATENT DOCUMENTS 5,105,742 A 4/1992 Sumner
5,119,729 A 6/1992 Nguyen
5,155,296 A 10/1992 Michaluk
5,159,145 A 10/1992 Carisella et al.
5,159,146 A 10/1992 Carisella et al.
5,165,489 A 11/1992 Langston
5,204,491 A 4/1993 Aureal et al.
5,211,714 A 5/1993 Jordan et al.
5,216,197 A 6/1993 Huber et al.
5,223,664 A 6/1993 Rogers
5,241,891 A 9/1993 Hayes et al.
5,322,019 A 6/1994 Hyland
5,323,684 A 6/1994 Umphries
5,347,929 A 9/1994 Lerche et al.
5,366,013 A 11/1994 Edwards et al.
5,392,851 A 2/1995 Arend
5,392,860 A 2/1995 Ross
5,436,791 A 7/1995 Furano et al.
5,479,860 A 1/1996 Ellis
5,503,077 A 4/1996 Motley
5,529,509 A 6/1996 Hayes et al.
5,540,154 A 7/1996 Wilcox et al.
5,551,346 A 9/1996 Walters et al.
5,551,520 A 9/1996 Bethel et al.
5,558,531 A 9/1996 Ikeda et al.
5,571,986 A 11/1996 Snider et al.
5,603,384 A 2/1997 Bethel et al.
5,648,635 A 7/1997 Lussier et al.
5,673,760 A 10/1997 Brooks et al.
5,703,319 A 12/1997 Fritz et al.
5,756,926 A 5/1998 Bonbrake et al.
5,759,056 A 6/1998 Costello et al.
5,765,962 A 6/1998 Cornell et al.
5,769,661 A 6/1998 Nealis
5,775,426 A 7/1998 Snider et al.
5,785,130 A 7/1998 Wesson et al.
5,803,175 A 9/1998 Myers, Jr. et al.
5,816,343 A 10/1998 Markel et al.
5,820,402 A 10/1998 Chiacchio et al.
5,837,925 A 11/1998 Nice
5,859,383 A 1/1999 Davison et al.
5,960,894 A 10/1999 Lilly et al.
5,964,294 A 10/1999 Edwards et al.
5,992,289 A 11/1999 George et al.
6,006,833 A 12/1999 Burleson et al.
6,012,525 A 1/2000 Burleson et al.
6,062,310 A 5/2000 Wesson et al.
6,085,659 A 7/2000 Beukes et al.
6,112,666 A 9/2000 Murray et al.
6,216,596 B1 4/2001 Wesson
6,263,283 B1 7/2001 Snider et al.
6,295,912 B1 10/2001 Burleson et al.
6,297,447 B1 10/2001 Burnett et al.
6,298,915 B1 10/2001 George
6,305,287 B1 10/2001 Capers et al.
6,333,699 B1 12/2001 Zierolf
6,354,374 B1 3/2002 Edwards et al.
6,378,438 B1 4/2002 Lussier et al.
6,385,031 B1 5/2002 Lerche et al.
6,386,108 B1 5/2002 Brooks et al.
6,397,947 B1 6/2002 Behrmann et al.
6,408,758 B1 6/2002 Duguet
6,412,388 B1 7/2002 Frazier
6,412,415 B1 7/2002 Kothari et al.
6,418,853 B1 7/2002 Duguet et al.
6,419,044 B1 7/2002 Tite et al.
6,439,121 B1 8/2002 Gillingham
6,467,415 B2 10/2002 Menzel et al.
6,487,973 B1 12/2002 Gilbert, Jr. et al.
6,497,285 B2 12/2002 Walker
6,508,176 B1 1/2003 Badger et al.
6,520,258 B1 2/2003 Yang et al.
6,591,911 B1 7/2003 Markel et al.
6,595,290 B2 7/2003 George et al.
6,618,237 B2 9/2003 Eddy et al.
6,651,747 B2 11/2003 Chen et al.
6,675,896 B2 1/2004 George
6,679,327 B2 1/2004 Sloan et al.
6,719,061 B2 4/2004 Muller et al.
6,739,265 B1 5/2004 Badger et al.
6,742,602 B2 6/2004 Trotechaud
6,752,083 B1 6/2004 Lerche et al.
6,772,868 B2 8/2004 Warner
6,773,312 B2 8/2004 Bauer et al.
6,779,605 B2 8/2004 Jackson
6,843,317 B2 1/2005 Mackenzie
6,851,471 B2 2/2005 Barlow et al.
6,942,033 B2 9/2005 Brooks et al.
7,000,699 B2 2/2006 Yang et al.
7,013,977 B2 3/2006 Nordaas
7,044,230 B2 5/2006 Starr et al.
7,093,664 B2 8/2006 Todd et al.
7,104,323 B2 9/2006 Cook et al.
7,107,908 B2 9/2006 Forman et al.
7,114,564 B2 10/2006 Parrott et al.
7,168,494 B2 1/2007 Starr et al.
7,182,611 B2 2/2007 Borden et al.
7,193,527 B2 3/2007 Hall
7,237,626 B2 7/2007 Gurjar et al.
7,243,722 B2 7/2007 Dosterling et al.
7,278,491 B2 10/2007 Scott
7,347,278 B2 3/2008 Lerche et al.
7,347,279 B2 3/2008 Li et al.
7,350,448 B2 4/2008 Bell et al.
7,353,879 B2 4/2008 Todd et al.
7,357,083 B2 4/2008 Takahara et al.
7,364,451 B2 4/2008 Ring et al.
7,387,162 B2 6/2008 Mooney, Jr. et al.
7,404,725 B2 7/2008 Hall et al.
7,441,601 B2 10/2008 George et al.
7,481,662 B1 1/2009 Rehrig
7,493,945 B2 2/2009 Doane et al.
7,510,017 B2 3/2009 Howell et al.
7,553,078 B2 6/2009 Hanzawa et al.
7,568,429 B2 8/2009 Hummel et al.
7,591,212 B2 9/2009 Myers, Jr. et al.
7,607,379 B2 10/2009 Rospek et al.
7,661,366 B2 2/2010 Fuller et al.
7,661,474 B2 2/2010 Campbell et al.
7,726,396 B2 6/2010 Briquet et al.
7,735,578 B2 6/2010 Loehr et al.
7,748,447 B2 7/2010 Moore
7,752,971 B2 7/2010 Loehr
7,762,172 B2 7/2010 Li et al.
7,762,331 B2 7/2010 Goodman et al.
7,762,351 B2 7/2010 Vidal
7,775,279 B2 8/2010 Marya et al.
7,778,006 B2 8/2010 Stewart et al.
7,810,430 B2 10/2010 Chan et al.
7,823,508 B2 11/2010 Anderson et al.
7,901,247 B2 3/2011 Ring
7,908,970 B1 3/2011 Jakaboski et al.
7,929,270 B2 4/2011 Hummel et al.
7,934,453 B2 5/2011 Moore
7,952,035 B2 5/2011 Falk et al.
7,980,874 B2 7/2011 Finke et al.
8,028,624 B2 10/2011 Mattson
8,061,425 B2 11/2011 Hales et al.
8,066,083 B2 11/2011 Hales et al.
8,069,789 B2 12/2011 Hummel et al.
8,074,737 B2 12/2011 Hill et al.
8,091,477 B2 1/2012 Brooks et al.
8,127,846 B2 3/2012 Hill et al.
8,127,848 B2 3/2012 Myers, Jr. et al.
8,141,434 B2 3/2012 Kippersund et al.
8,151,882 B2 4/2012 Grigar et al.
8,157,022 B2 4/2012 Bertoja et al.
8,181,718 B2 5/2012 Burleson et al.
8,182,212 B2 5/2012 Parcell
8,186,259 B2 5/2012 Burleson et al.
8,256,337 B2 9/2012 Hill
8,297,345 B2 10/2012 Emerson
8,327,746 B2 12/2012 Behrmann et al.
8,336,437 B2 12/2012 Barlow et al.

(56) References Cited

U.S. PATENT DOCUMENTS 8,388,374 B2 3/2013 Grek et al.
8,395,878 B2 3/2013 Stewart et al.
8,413,727 B2 4/2013 Holmes
D682,384 S 5/2013 Jaureguizar
8,439,114 B2 5/2013 Parrott et al.
8,443,886 B2 5/2013 Torres et al.
8,449,308 B2 5/2013 Smith
8,451,137 B2 5/2013 Bonavides et al.
8,468,944 B2 6/2013 Givens et al.
8,576,090 B2 11/2013 Lerche et al.
8,578,090 B1 11/2013 Jernigan, IV
8,596,378 B2 12/2013 Mason et al.
8,661,978 B2 3/2014 Backhus et al.
8,678,666 B2 3/2014 Scadden et al.
8,689,868 B2 4/2014 Lerche et al.
8,695,506 B2 4/2014 Lanclos
8,807,003 B2 8/2014 Le et al.
8,833,441 B2 9/2014 Fielder et al.
8,863,665 B2 10/2014 DeVries et al.
8,869,887 B2 10/2014 Deere et al.
8,875,787 B2 11/2014 Tassaroli
8,875,796 B2 11/2014 Hales et al.
8,881,816 B2 11/2014 Glenn et al.
8,884,778 B2 11/2014 Lerche et al.
8,904,935 B1 12/2014 Brown et al.
8,943,943 B2 2/2015 Tassaroli
8,960,093 B2 2/2015 Preiss et al.
8,960,288 B2 2/2015 Sampson
8,985,023 B2 3/2015 Mason
9,038,521 B1 5/2015 Rollins et al.
9,080,433 B2 7/2015 Lanclos et al.
9,115,572 B1 8/2015 Hardesty et al.
9,133,695 B2 9/2015 Xu
9,145,763 B1 9/2015 Sites, Jr.
9,145,764 B2 9/2015 Burton et al.
9,175,553 B2 11/2015 Mccann et al.
9,181,790 B2 11/2015 Mace et al.
9,194,219 B1 11/2015 Hardesty et al.
9,206,675 B2 12/2015 Hales et al.
9,284,819 B2 3/2016 Tolman et al.
9,284,824 B2 3/2016 Fadul et al.
9,317,038 B2 4/2016 Ozick et al.
9,359,863 B2 6/2016 Streich et al.
9,382,783 B2 7/2016 Langford et al.
9,382,784 B1 7/2016 Hardesty et al.
9,383,237 B2 7/2016 Wiklund et al.
9,441,465 B2 9/2016 Tassaroli
9,476,289 B2 10/2016 Wells
9,494,021 B2 11/2016 Parks et al.
9,523,265 B2 12/2016 Upchurch et al.
9,562,421 B2 2/2017 Hardesty et al.
9,581,422 B2 2/2017 Preiss et al.
9,598,942 B2 3/2017 Wells et al.
9,605,937 B2 3/2017 Eitschberger et al.
9,612,093 B2 4/2017 Collier et al.
9,677,363 B2 6/2017 Schacherer et al.
9,689,223 B2 6/2017 Schacherer et al.
9,689,226 B2 6/2017 Barbee et al.
9,702,211 B2 7/2017 Tinnen
9,702,680 B2 7/2017 Parks et al.
9,709,373 B2 7/2017 Hikone et al.
9,735,405 B1 8/2017 Petkus et al.
9,784,549 B2 10/2017 Eitschberger
9,835,015 B2 12/2017 Hardesty
9,845,666 B2 12/2017 Hardesty et al.
9,903,185 B2 2/2018 Ursi et al.
9,903,192 B2 2/2018 Entchev et al.
9,926,750 B2 3/2018 Ringgenberg
10,054,414 B2 8/2018 Scheid et al.
10,060,234 B2 8/2018 Robey et al.
10,066,921 B2 9/2018 Eitschberger
10,077,626 B2 9/2018 Xu et al.
10,077,641 B2 9/2018 Rogman et al.
10,138,713 B2 11/2018 Tolman et al.
10,151,180 B2 12/2018 Robey et al.
10,151,181 B2 12/2018 Lopez et al.
10,174,595 B2 1/2019 Knight et al.
10,188,990 B2 1/2019 Burmeister et al.
10,190,398 B2 1/2019 Goodman et al.
10,208,573 B2 2/2019 Kaenel et al.
10,273,788 B2 4/2019 Bradley et al.
10,364,387 B2 7/2019 Collier et al.
10,386,168 B1 8/2019 Preiss et al.
10,422,195 B2 9/2019 LaGrange et al.
10,429,161 B2 10/2019 Parks et al.
10,458,212 B2 10/2019 Collins et al.
10,458,213 B1 10/2019 Eitschberger et al.
10,465,488 B2 11/2019 Collins et al.
10,472,938 B2 11/2019 Parks et al.
10,488,163 B2 11/2019 Collins et al.
10,507,433 B2 12/2019 Eitschberger et al.
D873,373 S 1/2020 Hartman et al.
10,641,068 B2 5/2020 Hardesty et al.
10,677,026 B2 6/2020 Sokolove et al.
10,689,955 B1 6/2020 Mauldin et al.
10,731,443 B2 8/2020 Kaenel et al.
10,746,003 B2 8/2020 Yang et al.
10,844,696 B2 11/2020 Eitschberger et al.
10,844,697 B2 11/2020 Preiss et al.
10,845,177 B2 11/2020 Preiss et al.
10,858,919 B2 12/2020 Anthony et al.
10,900,334 B2 1/2021 Knight et al.
10,900,335 B2 1/2021 Knight et al.
10,920,543 B2 2/2021 Eitschberger
10,954,761 B2 3/2021 Kaenel et al.
10,982,513 B2 4/2021 Gupta et al.
11,053,782 B2 7/2021 Loehken et al.
11,078,762 B2 8/2021 Mauldin et al.
11,199,076 B2 12/2021 Collins et al.
11,215,041 B2 1/2022 Knight et al.
11,339,632 B2 5/2022 Eitschberger et al.
2002/0020320 A1 2/2002 Lebaudy et al.
2002/0062991 A1 5/2002 Farrant et al.
2002/0185275 A1 12/2002 Yang et al.
2003/0000411 A1 1/2003 Cernocky et al.
2003/0001753 A1 1/2003 Cernocky et al.
2003/0098158 A1 5/2003 George et al.
2004/0141279 A1 7/2004 Amano et al.
2004/0216633 A1 11/2004 Kash
2004/0216866 A1 11/2004 Barlow et al.
2005/0173118 A1 8/2005 Li et al.
2005/0178282 A1 8/2005 Brooks et al.
2005/0183610 A1 8/2005 Barton et al.
2005/0186823 A1 8/2005 Ring et al.
2005/0194146 A1 9/2005 Barker et al.
2005/0229805 A1 10/2005 Myers, Jr. et al.
2006/0075889 A1 4/2006 Walker
2007/0079966 A1 4/2007 George et al.
2007/0084336 A1 4/2007 Neves
2007/0119327 A1 5/2007 Myers et al.
2007/0125540 A1 6/2007 Gerez et al.
2007/0158071 A1 7/2007 Mooney, Jr. et al.
2007/0158109 A1 7/2007 Zazovsky et al.
2008/0047456 A1 2/2008 Li et al.
2008/0047716 A1 2/2008 McKee et al.
2008/0110612 A1 5/2008 Prinz et al.
2008/0121095 A1 5/2008 Han et al.
2008/0134922 A1 6/2008 Grattan et al.
2008/0149338 A1 6/2008 Goodman et al.
2008/0173204 A1 7/2008 Anderson et al.
2008/0173240 A1 7/2008 Furukawahara et al.
2008/0264639 A1 10/2008 Parrott et al.
2009/0050322 A1 2/2009 Hill et al.
2009/0151588 A1 6/2009 Burleson et al.
2009/0159283 A1 6/2009 Fuller et al.
2009/0159285 A1 6/2009 Goodman
2009/0183916 A1 7/2009 Pratt et al.
2009/0272519 A1 11/2009 Green et al.
2009/0272529 A1 11/2009 Crawford
2009/0301723 A1 12/2009 Gray
2010/0000789 A1 1/2010 Barton et al.
2010/0089643 A1 4/2010 Vidal
2010/0096131 A1 4/2010 Hill et al.
2010/0107917 A1 5/2010 Moser

(56) References Cited

U.S. PATENT DOCUMENTS

2010/0163224 A1 7/2010 Strickland
2010/0230104 A1 9/2010 Nölke et al.
2010/0230163 A1 9/2010 Hales et al.
2010/0252323 A1 10/2010 Goodman et al.
2011/0024116 A1 2/2011 McCann et al.
2011/0042069 A1 2/2011 Bailey et al.
2011/0100627 A1 5/2011 Hales et al.
2012/0006217 A1 1/2012 Anderson
2012/0085538 A1 4/2012 Guerrero et al.
2012/0094553 A1 4/2012 Fujiwara et al.
2012/0160483 A1 6/2012 Carisella
2012/0160491 A1 6/2012 Goodman et al.
2012/0199031 A1 8/2012 Lanclos
2012/0199352 A1 8/2012 Lanclos et al.
2012/0241169 A1 9/2012 Hales et al.
2012/0242135 A1 9/2012 Thomson et al.
2012/0247769 A1 10/2012 Schacherer et al.
2012/0247771 A1 10/2012 Black et al.
2012/0298361 A1 11/2012 Sampson
2013/0008639 A1 1/2013 Tassaroli et al.
2013/0008669 A1 1/2013 Deere et al.
2013/0037255 A1 2/2013 Kash et al.
2013/0043074 A1 2/2013 Tassaroli
2013/0062055 A1 3/2013 Tolman et al.
2013/0118342 A1 5/2013 Tassaroli
2013/0199843 A1 8/2013 Ross
2013/0220614 A1 8/2013 Torres et al.
2013/0248174 A1 9/2013 Dale et al.
2014/0000877 A1 1/2014 Robertson et al.
2014/0033939 A1 2/2014 Priess et al.
2014/0053750 A1 2/2014 Lownds et al.
2014/0131035 A1 5/2014 Entchev et al.
2014/0144702 A1 5/2014 Walker
2015/0176386 A1 6/2015 Castillo et al.
2015/0226044 A1 8/2015 Ursi et al.
2015/0330192 A1 11/2015 Rogman et al.
2015/0376991 A1 12/2015 Mcnelis et al.
2016/0040520 A1 2/2016 Tolman et al.
2016/0061572 A1 3/2016 Eitschberger et al.
2016/0069163 A1 3/2016 Tolman et al.
2016/0084048 A1 3/2016 Harrigan et al.
2016/0168961 A1 6/2016 Parks et al.
2016/0208587 A1 7/2016 Hardesty et al.
2016/0290084 A1 10/2016 LaGrange et al.
2016/0356132 A1 12/2016 Burmeister et al.
2017/0030693 A1 2/2017 Preiss et al.
2017/0052011 A1* 2/2017 Parks ..... E21B 43/1185
2017/0145798 A1 5/2017 Robey et al.
2017/0167233 A1 6/2017 Sampson et al.
2017/0199015 A1 7/2017 Collins et al.
2017/0211363 A1 7/2017 Bradley et al.
2017/0241244 A1 8/2017 Barker et al.
2017/0268317 A1 9/2017 Kaenel et al.
2017/0268860 A1 9/2017 Eitschberger
2017/0275976 A1 9/2017 Collins et al.
2017/0276465 A1 9/2017 Parks et al.
2017/0298716 A1 10/2017 McConnell et al.
2017/0314372 A1 11/2017 Tolman et al.
2017/0314373 A9 11/2017 Bradley et al.
2018/0030334 A1 2/2018 Collier et al.
2018/0094910 A1 4/2018 Ashton et al.
2018/0135398 A1 5/2018 Entchev et al.
2018/0202789 A1 7/2018 Parks et al.
2018/0202790 A1 7/2018 Parks et al.
2018/0209250 A1 7/2018 Daly et al.
2018/0209251 A1 7/2018 Robey et al.
2018/0216445 A1 8/2018 Collins et al.
2018/0274342 A1 9/2018 Sites
2018/0299239 A1 10/2018 Eitschberger et al.
2018/0306010 A1* 10/2018 Von Kaenel ..... E21B 43/117
2018/0318770 A1 11/2018 Eitschberger et al.
2019/0040722 A1 2/2019 Yang et al.
2019/0048693 A1 2/2019 Henke et al.
2019/0049225 A1 2/2019 Eitschberger
2019/0162055 A1 5/2019 Collins et al.
2019/0195054 A1 6/2019 Bradley et al.
2019/0211655 A1 7/2019 Bradley et al.
2019/0219375 A1 7/2019 Parks et al.
2019/0264548 A1 8/2019 Zhao et al.
2019/0284889 A1 9/2019 LaGrange et al.
2019/0292887 A1 9/2019 Austin, II et al.
2019/0316449 A1 10/2019 Schultz et al.
2019/0330961 A1 10/2019 Knight et al.
2019/0353013 A1 11/2019 Sokolove et al.
2019/0366272 A1 12/2019 Eitschberger et al.
2019/0368318 A1 12/2019 Loehken et al.
2019/0368319 A1 12/2019 Collins et al.
2020/0024934 A1 1/2020 Eitschberger et al.
2020/0024935 A1 1/2020 Eitschberger et al.
2020/0032626 A1 1/2020 Parks et al.
2020/0040714 A1 2/2020 Surjaatmadja et al.
2020/0072029 A1 3/2020 Anthony et al.
2020/0088011 A1 3/2020 Eitschberger et al.
2020/0157924 A1 5/2020 Melhus et al.
2020/0199983 A1 6/2020 Preiss et al.
2020/0256168 A1 8/2020 Knight et al.
2020/0308938 A1 10/2020 Sullivan et al.
2020/0332630 A1 10/2020 Davis et al.
2020/0386060 A1 12/2020 Sullivan et al.
2020/0392821 A1 12/2020 Eitschberger et al.
2021/0277752 A1* 9/2021 Eitschberger ..... E21B 43/1185
2021/0277753 A1 9/2021 Ursi et al.
2021/0348485 A1 11/2021 Mauldin et al.
2022/0154560 A1 5/2022 Eitschberger et al.

FOREIGN PATENT DOCUMENTS

CA 2824838 A1 2/2015
CA 2821506 C 3/2020
CA 3053174 C 1/2021
CN 85107897 A 9/1986
CN 85101675 A 1/1987
CN 2648065 10/2004
CN 2661919 12/2004
CN 2821154 9/2006
CN 201209435 3/2009
CN 101397890 A 4/2009
CN 101435829 A 5/2009
CN 101691837 B 4/2010
CN 101178005 B 10/2010
CN 201620848 U 11/2010
CN 201764910 U 3/2011
CN 202165062 U 3/2012
CN 102878877 A 1/2013
CN 202810806 U 3/2013
CN 103993861 A 8/2014
CN 104278976 A 1/2015
CN 204200197 U 3/2015
CN 104989335 A 10/2015
CN 205805521 U 12/2016
CN 208280947 U 12/2018
DE 102007007498 10/2015
EP 0160449 A1 11/1985
EP 0180520 B1 5/1991
EP 1473437 A2 11/2004
EP 2702349 B1 11/2015
GB 2383236 B 1/2004
GB 2404291 A 1/2005
GB 2533822 A 7/2016
GB 2531450 B 2/2017
GB 2548203 A 9/2017
JP 2003329399 A 11/2003
RU 2091567 C1 9/1997
RU 7852 U1 10/1998
RU 2211917 C1 9/2003
RU 2224095 C1 2/2004
RU 93521 U1 4/2010
RU 100552 U1 12/2010
RU 2579307 C1 4/2016
RU 2633904 C1 10/2017
WO 0159401 A1 8/2001
WO 2001059401 A1 8/2001
WO 2008067771 A1 6/2008
WO 2008098052 A3 10/2008

(56) References Cited

FOREIGN PATENT DOCUMENTS

| | | | |
|---|---|---|---|
| WO | 2009091422 | A2 | 7/2009 |
| WO | 2009091422 | A3 | 3/2010 |
| WO | 2012006357 | A2 | 1/2012 |
| WO | 2012106640 | A3 | 11/2012 |
| WO | 2012149584 | A1 | 11/2012 |
| WO | 2014046670 | A1 | 3/2014 |
| WO | 2014179689 | A1 | 11/2014 |
| WO | 2015006869 | A1 | 1/2015 |
| WO | 2015028204 | A2 | 3/2015 |
| WO | 2015134719 | A1 | 9/2015 |
| WO | 2015196095 | A1 | 12/2015 |
| WO | 2016037122 | A1 | 3/2016 |
| WO | 2016100269 | A1 | 6/2016 |
| WO | 2018009223 | A1 | 1/2018 |
| WO | 2018026952 | A1 | 2/2018 |
| WO | 2018125180 | A1 | 7/2018 |
| WO | 2018177733 | A1 | 10/2018 |
| WO | 2019009735 | A1 | 1/2019 |
| WO | 2019148009 | A2 | 8/2019 |
| WO | 2020016644 | A1 | 1/2020 |
| WO | 2020112983 | A1 | 6/2020 |
| WO | 2020200935 | A1 | 10/2020 |
| WO | 2020232242 | A1 | 11/2020 |
| WO | 2020249744 | A2 | 12/2020 |
| WO | 2021025716 | A1 | 2/2021 |
| WO | 2021116338 | A1 | 6/2021 |
| WO | 2021122797 | A1 | 6/2021 |
| WO | 2022084363 | A1 | 4/2022 |

OTHER PUBLICATIONS

WIPO, Written Opinion of International Searching Authority for PCT Application No. PCT/CA2014/050673, dated Oct. 9, 2014, 4 pgs.

Canadian Intellectual Property Office, Office Action for CA App. No. 2923860 dated Jul. 14, 2017, 3 pages.

Canadian Intellectual Property Office, Office Action for CA App. No. 2923860 dated Nov. 25, 2016, 3 pages.

Canadian Intellectual Property Office; First Office Action for CA App. No. 2933756; dated May 25, 2017; 2 pages.

Canadian Intellectual Property Office; Fourth Office Action for CA App. No. 2933756; dated May 31, 2019; 3 pages.

Canadian Intellectual Property Office; Second Office Action for CA App. No. 2933756; dated Jan. 29, 2018; 3 pages.

Canadian Intellectual Property Office; Third Office Action for CA App. No. 2933756; dated Jul. 31, 2018; 2 pages.

DynaEnergetics Europe; Exhibit B Invalidity Claim Chart for Civil Action No. 4:19-cv-01611; dated May 2, 2019; 52 pages.

DynaEnergetics Europe; Exhibit C Invalidity Claim Chart for Civil Action No. 4:17-cv-03784; dated Jul. 13, 2020; 114 pages.

DynaEnergetics Europe; Plaintiffs' Local Patent Rule 3-1 Infringement Contentions for Civil Action No. 4:19-cv-01611; dated May 25, 2018; 10 Pages.

DynaEnergetics Europe; Plaintiffs' Motion to Dismiss Defendants' Counterclaim and to strike Affirmative Defenses, Civil Action No. 4:17-cv-03784; dated Feb. 20, 2018; 9 pages.

DynaEnergetics Europe; Plaintiffs' Preliminary Claim Constructions and Identification of Extrinsic Evidence Civil Action No. 4:17-cv-03784; dated Aug. 3, 2018; 9 pages.

DynaEnergetics Europe; Plaintiffs' Preliminary Infringement Contentions, Civil Action No. 6:20-cv-00069-ADA; dated Apr. 22, 2020; 32 pages.

DynaEnergetics Europe; Plaintiffs' Reply in Support of Motion to Dismiss and Strike for Civil Action No. 6:20-cv-00069-ADA; dated Apr. 29, 2020; 15 pages.

DynaEnergetics Europe; Plaintiffs Response to Defendant Hunting Titan Ins' Inoperative First Amended Answer, Affirmative Defenses, and Counterclaims for Civil Action No. 6:20-cv-00069-ADA; dated May 13, 2020.

DynaEnergetics Europe; Plaintiffs' Response to Defendants' Answer to Second Amended Complaint Civil Action No. 6:20-cv-00069-ADA; dated May 26, 2020; 18 pages.

European Patent Office; First Office Action for EP App. No. 15796416.4; dated Nov. 4, 2016; 2 pages.

European Patent Office; Second Office Action for EP App. No. 15796416.4; dated Sep. 26, 2017; 4 pages.

European Patent Office; Third Office Action for EP App. No. 15796416.4; dated Jul. 19, 2018; 3 pages.

Federal Institute of Industrial Property; Decision of Granting for RU Appl. No. 2016104882/03(007851); dated May 17, 2018; 15 pages (English translation 4 pages).

Federal Institute of Industrial Property; Decision on Granting for RU Application No. 2016109329/03; dated Oct. 21, 2019; 11 pages (English translation 4 pages).

Federal Institute of Industrial Property; Decision on Granting for RU Application No. 2019137475/03; dated May 12, 2020; 15 pages (English translation 4 pages).

Federal Institute of Industrial Property; Inquiry for RU App. No. 2016109329/03(014605); issued Jul. 10, 2019; 7 pages (Eng. Translation 5 pages).

GB Intellectual Property Office, Combined Search and Examination Report for GB App. No. GB1700625.5, dated Jul. 7, 2017, 5 pages.

Hunting Titan Ltd.; Defendants Invalidity Contentions Pursuant to Patent Rule 3-3, Civil Action No. 4:17-cv-03784; dated Jul. 6, 2018; 29 pages.

Hunting Titan Ltd.; Defendants' Objections and Responses to Plaintiffs' First Set of Interrogatories, Civil Action No. 4:17-cv-03784; dated Jun. 11, 2018.

Hunting Titan Ltd.; Defendants' Opposition to Plaintiffs' Motion to Dismiss and Strike Defendants' Amended Counterclaim and Affirmative Defenses for Unenforceability due to Inequitable Conduct for Civil Action No. 4:17-cv-03784; dated Apr. 24, 2018; 8 pages.

International Searching Authority, International Search Report and Written Opinion for PCT App. No. PCT/IB2019/000569; dated Oct. 9, 2019, 12 pages.

James E. Fritz, Separation Joint Technology, American Institute of Aeronautics and Astronautics, 39th AIAA/ASME/SAE/ASEE Joint Propulsion Conference, Huntsville, AL, Jul. 20-23, 2003, 8 pgs., https://www.eba-d.com/assets/AIAA-2003-4436-Separation-Joint-Tech.pdf.

Norwegian Industrial Property Office; Opinion for NO Appl. No. 20171759; dated Apr. 5, 2019; 1 page.

Owen Oil Tools, Expendable Perforating Guns, Jul. 2008, 7 pgs., https://www.corelab.com/owen/cms/docs/Canada/10A_erhsc-01.0-c.pdf.

Owens Oil Tools, E & B Select Fire Side Port Tandem Sub Assembly, 2009, 9 pgs., https://www.corelab.com/owen/CMS/docs/Manuals/gunsys/MAN-30-XXX-0002-96-R00.pdf.

PCT Search Report and Written Opinion, dated May 4, 2015: See Search Report and Written opinion for PCT Application No. PCT/EP2014/065752, 12 pgs.

Schlumberger; Selective Perforation: A Game Changer in Perforating Technology—Case Study; issued 2012; 14 pages.

UK Examination Report of United Kingdom Patent Application No. GB1600085.3, which is in the same family as U.S. Pat. No. 9,702,680 dated Jul. 11, 2017, dated Mar. 9, 2016, 1 pg.

United States Patent and Trademark Office, Notice of Allowance for U.S. Appl. No. 29/729,981, filed Sep. 18, 2020, 9 pages.

United States Patent and Trademark Office, Non-final Office Action of U.S. Appl. No. 16/455,816, dated Nov. 5, 2019, 17 pgs.

United States Patent and Trademark Office, Notice of Allowance of U.S. Appl. No. 16/272,326, dated Sep. 4, 2019. 9 pgs.

United States Patent and Trademark Office, Office Action of U.S. Appl. No. 16/423,789, dated Feb. 18, 2020, 14 pgs.

United States Patent and Trademark Office, Office Action of U.S. Appl. No. 16/455,816, dated Apr. 20, 2020, 21 pgs.

United States Patent and Trademark Office, Office Action of U.S. Appl. No. 16/455,816, dated Jan. 13, 2020, 14 pgs.

United States Patent and Trademark Office, Office Action of U.S. Appl. No. 16/511,495, dated Aug. 27, 2020, 20 pgs.

United States Patent and Trademark Office; Final Office Action for U.S. Appl. No. 16/299,952; dated May 15, 2020; 10 pages.

(56) References Cited

OTHER PUBLICATIONS

United States Patent and Trademark Office; Final Office Action for U.S. Appl. No. 16/540,484; dated Feb. 19, 2021; 12 pages.
United States Patent and Trademark Office; Non-Final Office Action for U.S. Appl. No. 16/379,341; dated Sep. 21, 2020; 15 pages.
United States Patent and Trademark Office; Non-Final Office Action for U.S. Appl. No. 16/542,890; dated Nov. 4, 2019; 16 pages.
United States Patent and Trademark Office; Non-Final Office Action for U.S. Appl. No. 16/299,952; dated Oct. 18, 2019; 12 pages.
United States Patent and Trademark Office; Notice of Allowability for U.S. Appl. No. 14/908,788; dated Dec. 27, 2017; 5 pages.
United States Patent and Trademark Office; Notice of Non-Compliant Amendment for U.S. Appl. No. 16/299,952; dated Apr. 23, 2020; 2 pages.
United States Patent and Trademark Office; Office Action of U.S. Appl. No. 16/540,484, dated Aug. 20, 2020, 10 pgs.
Wade et al., Field Tests Indicate New Perforating Devices Improve Efficiency in Casing Completion Operations, SPE 381, pp. 1069-1073, Oct. 1962, 5 pgs.
Canadian Intellectual Property Office; Office Action for CA Application No. 3,070,118; dated Nov. 17, 2021; 3 pages.
International Searching Authority; International Search Report and Written Opinion for International Application No. PCT/US19/15255; dated Apr. 23, 2019; 12 pages.
Norwegian Industrial Property Office; Office Action for NO Application No. 20210799; dated Oct. 30, 2021; 2 pages.
Schlumberger Technology Corporation, Defendant Schlumberger Technology Corporation's Opening Claim Construction Brief for Civil Action No. 6:21-cv-00225-ADA; dated Oct. 6, 2021; 27pages.
Schlumberger Technology Corporation; Defendant Schlumberger Technology Corporation's Reply To Plaintiffs' Responsive Claim Construction Brief; dated Nov. 10, 2021; 17 pages.
Schlumberger Technology Corporation; Petitioner's Reply to Patent Owner's Preliminary Response; dated Oct. 13, 2021; 14 pages.
United States Patent and Trademark Office; Final Office Action for U.S. Appl. No. 16/809,729; dated Nov. 18, 2021; 16 pages.
United States Patent and Trademark Office; Non-Final Office Action for U.S. Appl. No. 17/352,728; dated Oct. 25, 2021; 9 pages.
Amit Govil, Selective Perforation: A Game Changer in Perforating Technology—Case Study, presented at the 2012 European and West African Perforating Symposium, Schlumberger, Nov. 7-9, 2012, 14 pgs.
Austin Powder Company; A—140 F & Block, Detonator & Block Assembly; Jan. 5, 2017; 2 pgs.; https://www.austinpowder.com/wp-content/uploads/2019/01/OilStar_A140Fbk-2.pdf.
Baker Hughes, Long Gun Deployment Systems IPS-12-28; 2012 International Perforating Symposium; Apr. 26-27, 2011; 11 pages.
Baker Hughes; SurePerf Rapid Select-Fire System Perforate production zones in a single run; 2012; 2 pages.
DynaEnergetics, DYNAselect Electronic Detonator 0015 SFDE RDX 1.4B, Product Information, Dec. 16, 2011, 1 pg.
DynaEnergetics, DYNAselect Electronic Detonator 0015 SFDE RDX 1.4S, Product Information, Dec. 16, 2011, 1 pg.
DynaEnergetics, DYNAselect System, information downloaded from website, Jul. 3, 2013, 2 pages, http://www.dynaenergetics.com/.
DynaEnergetics, Electronic Top Fire Detonator, Product Information Sheet, Jul. 30, 2013, 1 pg.
DynaEnergetics, Gun Assembly, Product Summary Sheet, May 7, 2004, 1 page.
DynaEnergetics, Selective Perforating Switch, information downloaded from website, Jul. 3, 2013, 2 pages, http://www.dynaenergetics.com/.
DynaEnergetics, Selective Perforating Switch, Product Information Sheet, May 27, 2011, 1 pg.
Eric H. Findlay, Jury Trial Demand in Civil Action No. 6:20-cv-00069-ADA, dated Apr. 22, 2020, 32 pages.
Gilliat et al.; New Select-Fire System: Improved Reliability and Safety in Select Fire Operations; 2012; 16 pgs.
Horizontal Wireline Services, Presentation of a completion method of shale demonstrated through an example of Marcellus Shale, Pennsylvania, USA, Presented at 2012 International Perforating Symposium (Apr. 26-28, 2012), 17 pages.
Hunting Titan Inc.; Petition for Post Grant Review of U.S. Pat. No. 10,429,161; dated Jun. 30, 2020; 109 pages.
Hunting Titan, Wireline Top Fire Detonator Systems, Nov. 24, 2014, 2 pgs, http://www.hunting-intl.com/titan/perforating-guns-and-setting-tools/wireline-top-fire-detonator-systems.
Jet Research Center Inc., JRC Catalog, 2008, 36 pgs., https://www.jetresearch.com/content/dam/jrc/Documents/Books_Catalogs/06_Dets.pdf.
Jet Research Center Inc., Red RF Safe Detonators Brochure, 2008, 2 pages, www.jetresearch.com.
Owen Oil Tools & Pacific Scientific; RF-Safe Green Det, Side Block for Side Initiation, Jul. 26, 2017, 2 pgs.
Owen Oil Tools, Recommended Practice for Oilfield Explosive Safety, Presented at 2011 MENAPS Middle East and North Africa Perforating Symposium, Nov. 28-30, 2011, 6 pages.
Schlumberger & Said Abubakr, Combining and Customizing Technologies for Perforating Horizontal Wells in Algeria, Presented at 2011 MENAPS, Nov. 28-30, 2011, 20 pages.
Smylie, Tom, New Safe and Secure Detonators for the Industry's consideration, presented at Explosives Safety & Security Conference, Marathon Oil Co, Houston; Feb. 23-24, 2005, 20 pages.
U.S. Patent Trial and Appeal Board, Institution of Inter Partes Review of U.S. Pat. No. 9,581,422, Case IPR2018-00600,Aug. 21, 2018, 9 pages.
United States District Court for the Southern District of Texas Houston Division, Case 4:19-cv-01611 for U.S. Pat. No. 9,581,422B2, Plaintiff's Complaint and Exhibits, dated May 2, 2019, 26 pgs.
United States District Court for the Southern District of Texas Houston Division, Case 4:19-cv-01611 for U.S. Pat. No. 9,581,422B2, Defendant's Answers, Counterclaims and Exhibits, dated May 28, 2019, 135 pgs.
United States District Court for the Southern District of Texas Houston Division, Case 4:19-cv-01611 for U.S. Pat. No. 9,581,422B2, Plaintiffs' Motion to Dismiss and Exhibits, dated Jun. 17, 2019, 63 pgs.
United States Patent and Trademark Office, Case IPR2018-00600 for U.S. Pat. No. 9,581,422 B2, Reply In Support of Patent Owner's Motion to Amend, dated Mar. 21, 2019, 15 pgs.
United States Patent and Trademark Office, Case IPR2018-00600 for U.S. Pat. No. 9,581,422 B2, Decision of Precedential Opinion Panel, Granting Patent Owner's Request for Hearing and Granting Patent Owner's Motion to Amend, dated Jul. 6, 2020, 27 pgs.
United States Patent and Trademark Office, Case IPR2018-00600 for U.S. Pat. No. 9,581,422 B2, DynaEnergetics GmbH & Co. KG's Patent Owner Preliminary Response, dated May 22, 2018, 47 pgs.
United States Patent and Trademark Office, Case IPR2018-00600 for U.S. Pat. No. 9,581,422 B2, Drder Granting Precedential Opinion Panel, Paper No. 46, dated Nov. 7, 2019, 4 pgs.
United States Patent and Trademark Office, Case IPR2018-00600 for U.S. Pat. No. 9,581,422 B2, Patent Owner's Motion to Amend, dated Dec. 6, 2018, 53 pgs.
United States Patent and Trademark Office, Case IPR2018-00600 for U.S. Pat. No. 9,581,422 B2, Patent Owner's Opening Submission to Precedential Opinion Panel, dated Dec. 20, 2019, 21 pgs.
United States Patent and Trademark Office, Case IPR2018-00600 for U.S. Pat. No. 9,581,422 B2, Patent Owner's Request for Hearing, dated Sep. 18, 2019, 19 pgs.
United States Patent and Trademark Office, Case IPR2018-00600 for U.S. Pat. No. 9,581,422 B2, Patent Owner's Responsive Submission to Precedential Opinion Panel, dated Jan. 6, 2020, 16 pgs.
United States Patent and Trademark Office, Case IPR2018-00600 for U.S. Pat. No. 9,581,422 B2, Patent Owner's Sur-reply, dated Mar. 21, 2019, 28 pgs.
United States Patent and Trademark Office, Case IPR2018-00600 for U.S. Pat. No. 9,581,422 B2, Petitioner's Additional Briefing to the Precedential Opinion Panel, dated Dec. 20, 2019, 23 pgs.
United States Patent and Trademark Office, Case IPR2018-00600 for U.S. Pat. No. 9,581,422 B2, Petitioner's Opposition to Patent Owner's Motion to Amend, dated Mar. 7, 2019, 30 pgs.

(56) References Cited

OTHER PUBLICATIONS

United States Patent and Trademark Office, Case IPR2018-00600 for U.S. Pat. No. 9,581,422 B2, Petitioner's Reply Briefing to the Precedential Opinion Panel, dated Jan. 6, 2020, 17 pgs.
United States Patent and Trademark Office, Case IPR2018-00600 for U.S. Pat. No. 9,581,422 B2, Petitioner's Reply in Inter Partes Review of U.S. Pat. No. 9,581,422, dated Mar. 7, 2019, 44 pgs.
United States Patent and Trademark Office, Final Written Decision of Case IPR2018-00600 for U.S. Pat. No. 9,581,422 B2, Paper No. 42, dated Aug. 20, 2019, 31 pgs.
United States Patent and Trial Appeal Board; Final Written Decision on IPR2018-00600; dated Aug. 20, 2019; 31 pages.
C&J Energy Services; Gamechanger Perforating System Description; 2018; 1 pages.
C&J Energy Services; Gamechanger Perforating System Press Release; 2018; 4 pages.
Canadian Intellectual Property Office; Office Action for CA Application No. 3,070,118; dated Mar. 16, 2021; 3 pages.
DynaEnergetics Europe GMBH; Patent Owner's Preliminary Response for PGR No. 2021-00089; dated Sep. 16, 2021; 106 pages.
DynaEnergetics Europe GMBH; Patent Owner's Preliminary Response for PGR2021-00078; dated Aug. 19, 2021; 114 pages.
DynaEnergetics Europe GMBH; Plaintiff's Preliminary Infringement Contentions for Civil Action No. 6:21-cv-01110; dated Jul. 6, 2021; 6 pages.
DynaEnergetics Europe GMBH; Principal and Response Brief of Cross-Appellant for United States Court of Appeals case No. 2020-2163, -2191; dated Jan. 11, 2021; 95 pages.
DynaEnergetics Europe, GMBH; DynaEnergetics' Preliminary Claim Construction and Extrinsic Evidence for Civil Action No. 4:21-cv-00280; dated Aug. 4, 2021; 10 pages.
GB Intellectual Property Office, Combined Search and Examination Report for GB App. No. 1717516.7, dated Feb. 27, 2018, 6 pgs.
Geodynamics; Perforating Catalog; dated Mar. 5, 2020; 218 pages; https://www.perf.com/hubfs/PDF%20Files/PerforatingCatalog_03272020_SMS.pdf.
Hunting Titan Division, Marketing White Paper: H-1® Perforating Gun System, Jan. 2017, 5 pgs., http://www.hunting-intl.com/media/2674690/White%20Paper%20-%20H-1%20Perforating%20Gun%20Systems_January%202017.pdf.
Hunting Titan Ltd,; Defendants' Answer and Counterclaims, Civil Action No. 4:19-cv-01611, consolidated to Civil Action No. 4:17-cv-03784; dated May 28, 2019; 21 pages.
Hunting Titan, Inc.; Defendant's Answer, Affirmative Defenses, and Counterclaims to Plaintiffs' Second Amended Complaint for Civil Action No. 4:20-cv-02123; dated Sep. 10, 2021; 77 pages.
Hunting Titan, Inc; Petitioner's Sur-Reply on Patent Owner's Motion to Amend for IPR No. 2018-00600; dated Apr. 11, 2019; 17 pages.
International Searching Authority, International Search Report and Written Opinion of International App. No. PCT/IB2019/000569, dated Oct. 9, 2019, 12 pages.
International Searching Authority; International Search Report and Written Opinion for PCT Application No. EP2020066327; dated Jan. 11, 2021; 17 pages.
Nextier Oilfield Solutions Inc; Petition for Inter Partes Review No. IPR2021-00082; dated Oct. 21, 2020; 111 pages.
Nexus Perforating LLC; Complaint and Demand for Jury Trial for Civil Case No. 4:20-cv-01539; dated Apr. 30, 2020; 11 pages.
Nexus Perforating; Double Nexus Connect (Thunder Gun System) Description; Retrieved from the internet Jan. 27, 2021; 6 pages.
Patent Trial and Appeal Board; Decision Granting Patent Owner's Request for Rehearing and Motion to Amend for IPR2018-00600; dated Jul. 6, 2020; 27 pages.
Schlumberger Technology Corporation; Defendant's Preliminary Invalidity Contentions; dated Aug. 19, 2021; 213 pages.
Schlumberger Technology Corporation; Exhibit A-01 to Defendant's Preliminary Invalidity Contentions Invalidity of U.S. Pat. No. 10,844,696 over WO20190148009; dated Aug. 19, 2021; 267 pages.
Schlumberger Technology Corporation; Exhibit A-02 to Defendant's Preliminary Invalidity Contentions Invalidity of U.S. Pat. No. 10,844,696 over U.S. Pat. No. 4,598,775; dated Aug. 19, 2021; 178 pages.
Schlumberger Technology Corporation; Exhibit A-03 to Defendant's Preliminary Invalidity Contentions Invalidity of U.S. Pat. No. 10,844,696 over U.S. Pat. No. 4,753,301; dated Aug. 19, 2021; 178 pages.
Schlumberger Technology Corporation; Exhibit A-04 to Defendant's Preliminary Invalidity Contentions Invalidity of U.S. Pat. No. 10,844,696 over U.S. Pat. No. 10,746,003; dated Aug. 19, 2021; 186 pages.
Schlumberger Technology Corporation; Exhibit A-05 to Defendant's Preliminary Invalidity Contentions Invalidity of U.S. Pat. No. 10,844,696 over WO2017/024266; dated Aug. 19, 2021; 247 pages.
Schlumberger Technology Corporation; Exhibit A-06 to Defendant's Preliminary Invalidity Contentions Invalidity of U.S. Pat. No. 10,844,696 over U.S. Pat. No. 4,479,556; dated Aug. 19, 2021; 250 pages.
Schlumberger Technology Corporation; Exhibit A-07 to Defendant's Preliminary Invalidity Contentions Invalidity of U.S. Pat. No. 10,844,696 over US2017/0145798; dated Aug. 19, 2021; 279 pages.
SWM International, LLC and Nextier Oil Completion Solutions, LLC; Petition for Post Grant Review PGR No. 2021-00097; dated Jul. 20, 2021; 153 pages.
United States Patent and Trademark Office, Non-Final Office Action of U.S. Appl. No. 16/272,326, dated May 24, 2019, 17 pages.
United States Patent and Trademark Office; U.S. Appl. No. 62/736,298; dated Sep. 25, 2018; 120 pages.
United States Patent Trial and Appeal Board; Record of Oral Hearing held Feb. 18, 2020 for IPR dated 2018-00600; dated Feb. 18, 2020; 27 pages.
Waters & Wang, The Impact of Geomechanics and Perforation on Hydraulic Fracture Initiation & Complexity in Horizontal Well Completions, Sep. 26-28, 2016, SPE-181684-MS, 36 pg.
Alavi, Amir; Stipulation letter to Barry Herman; Exhibit 1026 of PGR No. 2021-00078 dated May 10, 2021; 2 pages.
Albright; Order Governing Proceedings—Patent Cases; Exhibit No. 1033 of PGR No. 2021-00089; 10 pages.
Bahr, Robert W.; Memorandum from Deputy Commissioner for Patent Examination Policy; dated Apr. 5, 2018; 7 pages.
Baker Hughes; Power charge, Slow set, Size 10 E4; dated Sep. 18, 2020; https://www.shopbakerhughes.com/wireline/power-charge-slow-set-size-10-e4-h437660010.html; 4 pages.
Baker Hughes; Power charge, Standard, Size 20 E4; dated Sep. 20, 2020; https://www.shopbakerhughes.com/wireline/power-charge-standard-size-20-e4-h437643223.html; 4 pages.
Baumann et al.; Perforating Innovations—Shooting Holes in Performance Models; Oilfield Review, Autumn 2014, vol. 26, Issue No. 3 pp. 14-31; 18 pages.
Bear Manufacturing; Defendant Bear Manufacturing, LLC's Answer, Affirmative Defenses and Counterclaim in response to Plaintiffs' Complaint for Civil Action No. 3:21-cv-00185-M; dated Mar. 22, 2021; 14 pages.
Bohanek, et al.; The Efficiency of Liner Shaped Charges; dated Jun. 2014; 8 pages.
Brazilian Patent and Trademark Office; Search Report for BR Application No. BR112015033010-0; dated May 6, 2020; (4 pages).
Buche & Associates, P.C.; Rule 501 Citation of Prior Art and Written "Claim Scope Statements" in U.S. Pat. No. 10,844,697; dated Mar. 3, 2021; 24 pages.
Canadian Intellectual Property Office; Notice of Allowance for CA Appl. No. 2,821,506; dated Jul. 31, 2019; 1 page.
Canadian Intellectual Property Office; Office Action for CA Appl. No. 2,821,506; dated Mar. 21, 2019; 4 pages.
Coaxial Power Connector; Exhibit 1017 of PGR 2021-00078; dated Mar. 22, 2021; 9 pages.
Coil Spring; Exhibit 1024 of PGR No. 2021-00078; dated Apr. 2, 2021; 4 pages.
ControlFire RF-Safe Assembly Gun Loading Manual; Exhibit No. 2004 of PGR No. 2020-00072; 33 pages.
ControlFire User Manual; Exhibit No. 2005 of PGR No. 2020-00072; 2014; 56 pages.

(56) References Cited

OTHER PUBLICATIONS

Cooperative Patent Classification; Fixed Constructions Earth Drilling, Mining; dated Feb. 2021; 25 pages.
CoreLab Quick Change Assembly; Exhibit No. 1034 of PGR No. 2021-00078; dated Aug. 2002; 1 page.
Dalia Abdallah et al., Casing Corrosion Measurement to Extend Asset Life, Dec. 31, 2013, 14 pgs., https://www.slb.com/-/media/files/oilfield-review/2-casing-corr-2-english.
Dyess, Adam; Declaration; dated May 30, 2021; 5 pages.
DynaEnergetics Europe GMBH; Patent Owner's Preliminary Response for PGR2020-00072; dated Oct. 23, 2020; 108 pages.
DynaEnergetics Europe GMBH; Patent Owner's Preliminary Response for PGR2020-00080; dated Nov. 18, 2020; 119 pages.
DynaEnergetics Europe; Defendants' Preliminary Infringement Contentions for Civil Action No. 3:20-CV-00376; dated Mar. 25, 2021; 22 pages.
DynaEnergetics Europe; DynaEnergetics Celebrates Grand Opening of DynaStage Manufacturing and Assembly Facilities in Blum, Texas; dated Nov. 16, 2018; 3 pages.
DynaEnergetics Europe; DynaEnergetics Europe GMBH and DynaEnergetics US, Inc.'s Answer to Complaint and Counterclaim Civil Action No. 3:20-cv-000376; dated Mar. 8, 2021; 23 pages.
DynaEnergetics Europe; Patent Owner's Preliminary Response for PGR No. 2020-00080; dated Nov. 18, 2020; 119 pages.
DynaEnergetics Europe; Petition to Correct Inventorship in Patent under 37 C.F.R § 1.324; dated Oct. 13, 2020; 21 pages.
DynaEnergetics exhibition and product briefing; Exhibit 2006 of PGR No. 2020-00072; dated 2013; 15 pages.
DynaEnergetics GMBH & Co. KG, Patent Owner's Response to Hunting Titan's Petition for Inter Parties Review—Case IPR2018-00600, filed Dec. 6, 2018, 73 pages.
DynaEnergetics GmbH & Co. KG; Patent Owner's Precedential Opinion Panel Request for Case IPR2018-00600; Sep. 18,2019, 2 pg.
DynaEnergetics; DynaStage Solution—Factory Assembled Performance-Assured Perforating Systems; 6 pages.
DynaStage Gun System; Exhibit 2009 of PGR No. 2020-00080; dated May 2014; 2 pages.
Electronic Patent Assignment System; Patent Assignment Cover Sheet for U.S. Appl. No. 13/331,596; dated Mar. 5, 2012; 8 pages.
Electronic Patent Assignment System; Patent Assignment Cover Sheet for U.S. Appl. No. 14/649,577; dated Sep. 21, 2015; 14 pages.
EP Patent Office—International Searching Authority, PCT Search Report and Written Opinion for PCT Application No. PCT/EP2014/065752, dated May 4, 2015, 12 pgs.
EQUAfrac Brochure; Exhibit No. 1016 of PGR No. 2021-00089; 6 pages.
EQUAfrac Shaped Charges; Exhibit No. 1018 of PGR No. 2021-00089; dated 2018; 2 pages.
European Patent Office; Invitation to Correct Deficiencies noted in the Written Opinion for European App. No. 15721178.0; dated Dec. 13, 2016; 2 pages.
European Patent Office; Office Action for EP App. No. 15721178.0; dated Sep. 6, 2018; 5 pages.
Federal Institute of Industrial Property; Inquiry for RU App. No. 2016104882/03(007851); dated Feb. 1, 2018; 7 pages, English Translation 4 pages.
Federal Institute of Industrial Property; Inquiry for RU Application No. 2016110014/03(015803); dated Feb. 1, 2018; 6 pages (Eng. Translation 4 pages).
G&H Diversified Manufacturing LP; Petition for Post Grant Review PGR No. 2021-00078; dated May 10, 2021; 122 pages.
GB Intellectual Property Office, Examination Report for GB App. No. GB1600085.3, dated Mar. 9, 2016, 1 pg.
GB Intellectual Property Office, Search Report for App. No. GB 1700625.5; dated Jul. 7, 2017; 5 pgs.
GB Intellectual Property Office; Examination Report for GB Appl. No. 1717516.7; dated Apr. 13, 2018; 3 pages.
GB Intellectual Property Office; Office Action for GB App. No. 1717516.7; dated Feb. 27, 2018; 6 pages.
GB Intellectual Property Office; Search Report for GB. Appl. No. 1700625.5; dated Dec. 21, 2017; 5 pages.
German Patent Office, Office Action for German Patent Application No. 10 2013 109 227.6, which is in the same family as PCT Application No. PCT/EP2014/065752, see p. 5 for references cited, May 22, 2014, 8 pgs.
Global Presence Hunting PLC—2014 Full Year Results; Exhibit No. 1019 of PGR No. 2021-00089; dated 2014; 30 pages.
Global Wireline Market; Exhibit 2010 of PGR 2020-00072; dated Oct. 15, 2019; 143 pages.
United States Patent and Trademark Office; Patent Prosecution History of U.S. Appl. No. 16/585,790; dated Nov. 24, 2020; 1,066 pages.
United States Patent and Trademark Office; Patent Prosecution History of U.S. Appl. No. 61/733,129; dated Jan. 3, 2013; 22 pages.
United States Patent and Trademark Office; Patent Prosecution History U.S. Appl. No. 61/439,217; dated Mar. 4, 2011; 31 pages.
United States Patent and Trademark Office; U.S. Appl. No. 62/002,559; dated May 23, 2014; 19 pages.
United States Patent and Trademark Office; U.S. Appl. No. 62/002,565; dated Jun. 25, 2014; 25 pages.
United States Patent and Trademark Office; U.S. Appl. No. 62/014,900; dated Jul. 7, 2014; 25 pages.
United States Patent and Trademark Office; U.S. Appl. No. 62/015,014; dated Jul. 7, 2014; 21 pages.
United States Patent and Trademark Office; U.S. Appl. No. 62/015,030; dated Jul. 14, 2014; 29 pages.
United States Patent and Trademark Office; U.S. Appl. No. 62/112,935; dated Feb. 6, 2015; 33 pages.
United States Patent and Trademark Office; U.S. Appl. No. 62/131,324; dated Mar. 24, 2015; 65 pages.
United States Patent and Trademark Office; U.S. Appl. No. 62/621,999; dated Jan. 25, 2018; 42 pages.
United States Patent and Trademark Office; U.S. Appl. No. 62/627,591; dated Feb. 7, 2018; 40 pages.
United States Patent Trial and Appeal Board; Decision Denying Institution of Post-Grant Review; PGR No. 2020-00072; dated Jan. 19, 2021; 38 pages.
United States Patent Trial and Appeal Board; Institution Decision for PGR 2020-00080; dated Feb. 12, 2021; 15 pages.
USPTO; Notice of Allowance for U.S. Appl. No. 14/904,788; dated Jul. 6, 2016; 8 pages.
Western District of Texas; Case Readiness Status Report for Civil Action No. 6:20-CV-01110-ADA; dated Mar. 25, 2021; 5 pages.
Western District of Texas; Order Governing Proceedings—Patent Case; dated Feb. 23, 2021; 10 pages.
Western District of Texas; Summons in a Civil Action Civil Action No. 6:20-cv-01110-ADA; dated Mar. 1, 2021; 3 pages.
World Oil; DynaEnergetics expands DynaStage factory-assembled, well perforating systems; dated Mar. 14, 2017; 2 pages.
Yang, Wenbo et al.; U.S. Appl. No. 60/314,200, filed Aug. 22, 2001; 15 pages.
Salt Warren et al.; New Perforating Gun System Increases Safety and Efficiency; dated Apr. 1, 2016; 11 pages.
Scharf Thilo; Declaration for PGR2020-00080; dated Nov. 16, 2020; 16 pages.
Scharf, Thilo; Declaration for PGR2020-00072; dated Oct. 22, 2020; 13 pages.
Schlumberger Technology Corporation; Petiton for Post Grant Review Case No. PGR2021-00089; dated Jun. 1, 2021; 155 pages.
Schlumberger; Fractal Flex Multistage stimulation perforating system; dated 2018; 1 page.
Select Fire System; Exhibit 1028 of PGR 2021-00078; dated 2012; 165 pages.
Sharma, Gaurav; Hunting Plc Is Not In A Race To The Bottom, Says Oilfield Services Firm's CEO; dated Sep. 10, 2019; retrieved on Nov. 18, 2020; 6 pages.
SIPO, Search Report dated Mar. 29, 2017, in Chinese: See Search Report for CN App. No. 201480040456.9, 12 pgs. (English Translation 3 pgs).
Southern District of Texas; Discovery Order for Civil Action No. 3:20-cv-000376; dated Mar. 12, 2021; 6 pages.

(56) References Cited

OTHER PUBLICATIONS

State Intellectual Property Office, P.R. China; First Office Action with full translation for CN App. No. 201480040456.9; dated Mar. 29, 2017; 12 pages (English translation 17 pages).
State Intellectual Property Office, P.R. China; Second Office Action for CN App. No. 201480040456.9; dated Nov. 29, 2017; 5 pages (English translation 1 page).
Stifel; Why the Big Pause? Balancing Long-Term Value with Near-Term Headwinds. Initiating Coverage of Oilfield Svcs and Equipment; dated Sep. 10, 2018; 207 pages.
United States Patent and Trademark Office, Non-final Office Action of U.S. Appl. No. 16/451,440, dated Oct. 24, 2019, 22 pgs.
United States Patent and Trademark Office, Non-final Office Action of U.S. Appl. No. 16/455,816, dated Jul. 2, 2020, 15 pgs.
United States Patent and Trademark Office, Notice of Allowance for U.S. Appl. No. 15/920,800, dated Jul. 7, 2020, 7 pgs.
United States Patent and Trademark Office, Notice of Allowance for U.S. Appl. No. 16/585,790, dated Jun. 19, 2020, 16 pgs.
United States Patent and Trademark Office, Office Action of U.S. Appl. No. 14/767,058, dated Jul. 15, 2016, 9 pgs.
United States Patent and Trademark Office, Office Action of U.S. Appl. No. 15/117,228, dated May 31, 2018, 9 pgs.
United States Patent and Trademark Office, Office Action of U.S. Appl. No. 15/617,344, dated Jan. 23, 2019, 5 pgs.
United States Patent and Trademark Office, Office Action of U.S. Appl. No. 15/788,367, dated Oct. 22, 2018, 6 pgs.
United States Patent and Trademark Office, Office Action of U.S. Appl. No. 15/920,800, dated Dec. 27, 2019, 6 pgs.
United States Patent and Trademark Office, Office Action of U.S. Appl. No. 15/920,812, dated Dec. 27, 2019, 6 pgs.
United States Patent and Trademark Office, Office Action of U.S. Appl. No. 15/920,812, dated May 27, 2020, 5 pgs.
United States Patent and Trademark Office, Office Action of U.S. Appl. No. 16/026,431, dated Jul. 30, 2019, 10 pgs.
United States Patent and Trademark Office, Office Action of U.S. Appl. No. 16/359,540, dated Aug. 14, 2019, 9 pgs.
United States Patent and Trademark Office, Office Action of U.S. Appl. No. 16/359,540, dated May 3, 2019, 11 pgs.
United States Patent and Trademark Office, Office Action of U.S. Appl. No. 16/540,484, dated Oct. 4, 2019, 12 pgs.
United States Patent and Trademark Office, Office Action of U.S. Appl. No. 16/585,790, dated Nov. 12, 2019, 9 pgs.
United States Patent and Trademark Office, Office Action of U.S. Appl. No. 16/809,729, dated Jun. 19, 2020, 9 pgs.
United States Patent and Trademark Office, Office Action of U.S. Appl. No. 29/733,080, dated Jun. 26, 2020, 8 pgs.
United States Patent and Trademark Office, U.S. Appl. No. 61/733,129, filed Dec. 4, 2012; 10 pages.
United States Patent and Trademark Office, U.S. Appl. No. 61/819,196, filed May 3, 2013 ; 10 pages.
United States Patent and Trademark Office; Final Office Action of U.S. Appl. No. 16/809,729, dated Nov. 3, 2020; 19 pages.
U.S. Pat. No. 10,844,696 part 1 of 5.
U.S. Pat. No. 10,844,696 part 2 of 5.
U.S. Pat. No. 10,844,696 part 3 of 5.
U.S. Pat. No. 10,844,696 part 4 of 5.
U.S. Pat. No. 10,844,696 part 5 of 5.
United States Patent and Trademark Office; Non-Final Office Action for U.S. Appl. No. 15/920,812; dated Feb. 3, 2021; 7 pages.
United States Patent and Trademark Office; Non-Final Office Action for U.S. Appl. No. 17/007,574; dated Jan. 29, 2021; 11 pages.
United States Patent and Trademark Office; Non-Final Office Action of U.S. Appl. No. 15/920,800; dated Dec. 9, 2020; 6 pages.
United States Patent and Trademark Office; Notice of Allowance for U.S. Appl. No. 15/920,812, dated Aug. 18, 2020; 5 pages.
United States Patent and Trademark Office; Notice of Allowance for U.S. Appl. No. 16/387,696; dated Jan. 29, 2020; 7 pages.
United States Patent and Trademark Office; Notice of Allowance for U.S. Appl. No. 16/585,790, dated Aug. 5, 2020; 15 pages.
United States Patent and Trademark Office; Notice of Allowance for U.S. Appl. No. 16/511,495; dated Dec. 15, 2020; 9 pages.
United States Patent and Trademark Office; Notice of Allowance for U.S. Appl. No. 16/455,816; dated Sep. 22, 2020; 12 pages.
United States Patent and Trademark Office; Notice of Allowance for U.S. Appl. No. 16/809,729; dated Jan. 26, 2021; 9 pages.
United States Patent and Trademark Office; Notice of Allowance for U.S. Appl. No. 17/007,574; dated May 21, 2021; 8 pages.
H-1 Perforating Gun System; Exhibit No. 1022 of PGR No. 2021-00089; dated May 1, 2020; 6 pages.
Halliburton Wireline & Perforating; Velocity Perforating System Plug and Play Guns for Pumpdown Operations; dated Mar. 2021; 8 pages.
Halliburton; Wireline and Perforating Advances in Perforating; dated Nov. 2012; 12 pages.
Hunting Titan Gun System Catalog; Exhibit No. 1035 of PGR No. 2021-00078; 59 pages.
Hunting Titan Inc.; Petition for Post Grant Review of U.S. Pat. No. 10,472,938; dated Aug. 12, 2020; 198 pages.
Hunting Titan Ltd.; Petition for Inter Partes Review of U.S. Pat. No. 9,581,422 Case No. IPR2018-00600; dated Feb. 16, 2018; 93 pages.
Hunting Titan Ltd.; Defendants' Answer and Counterclaims, Civil Action No. 6:20-cv-00069; dated Mar. 17, 2020; 30 pages.
Hunting Titan Ltd.; Defendants' Answer to First Amended Complaint and Counterclaims, Civil Action No. 6:20-cv-00069; dated Apr. 6, 2020; 30 pages.
Hunting Titan Ltd.; Defendants' Answer to Second Amended Complaint and Counterclaims, Civil Action No. 6:20-cv-00069; dated May 12, 2020; 81 pages.
Hunting Titan; Response to Canadian Office Action for CA App. No. 2,933,756; dated Nov. 23, 2017; 18 pages.
Hunting Wireline Hardware Brochures; Exhibit No. 1025 of PGR No. 2021-00078; dated 2013; 27 pages.
Industrial Property Office, Czech Republic; Office Action for CZ App. No. PV 2017-675; Jul. 18, 2018; 2 pages; Concise Statement of Relevance: Examiner's objection of CZ application claims 1, 7, and 16 based on US Pub No. 20050194146 alone or in combination with WO Pub No. 2001059401.
Industrial Property Office, Czech Republic; Office Action for CZ App. No. PV 2017-675; dated Oct. 26, 2018; 2 pages.
Intellectual Property India, Office Action of IN Application No. 201647004496, dated Jun. 7, 2019, 6 pgs.
International Searching Authority, International Preliminary Report on Patentability for PCT App. No. PCT/EP2014/065752; dated Mar. 1, 2016, 10 pgs.
International Searching Authority; International Preliminary Report on Patentability for PCT Appl. No. PCT/CA2014/050673; dated Jan. 19, 2016; 5 pages.
International Searching Authority; International Preliminary Report on Patentability for PCT Application No. PCT/EP2019/069165; dated Jan. 28, 2021; 9 pages.
International Searching Authority; International Preliminary Report on Patentability for PCT Application No. PCT/IB2019/000569; dated Jan. 28, 2021; 8 pages.
International Searching Authority; International Search Report and Written Opinion for PCT App. No. PCT/CA2014/050673; dated Oct. 9, 2014; 7 pages.
International Searching Authority; International Search Report and Written Opinion for PCT App. No. PCT/EP2015/059381; dated Nov. 23, 2015; 14 pages.
International Searching Authority; International Search Report and Written Opinion for PCT App. No. PCT/EP2019/069165; dated Oct. 22, 2019; 13 pages.
International Searching Authority; International Search Report and Written Opinion for PCT App. No. PCT/US2015/018906; dated Jul. 10, 2015; 12 pages.
International Searching Authority; International Search Report and Written Opinion of the International Searching Authority for PCT/EP2020/085624; dated Apr. 12, 2021; 11 pages.
International Searching Authority; International Search Report and Written Opinion of the International Searching Authority for PCT/EP2020/086496; dated Apr. 7, 2021; 10 pages.

(56) References Cited

OTHER PUBLICATIONS

Introduction to Seamless Pipe Manufacturing; Exhibit 1016 of PGR No. 2021-00078; 3 pages.
Isolation Sub Assembly; Exhibit No. 1027 of PGR No. 2021-00078; dated Mar. 2008; 5 pages.
Jet Research Centers, Capsule Gun Perforating Systems, Alvarado, Texas, 26 pgs., https://www.jetresearch.com/content/dam/jrc/Documents/Books_Catalogs/07_Cap_Gun.pdf.
Johnson, Bryce; Citation of Prior Art and Written Statements in Patent Files for U.S. Pat. No. 10,844,697; dated Apr. 29, 2021; 2 pages.
Johnson, Bryce; Rule 501 citation of prior art and written "claim scope statements" in U.S. Pat. No. 10,844,697; dated Apr. 29, 2021; 18 pages.
Marketing White Paper: EQUAfrac Shaped Charge; Exhibit 1017 of PGR No. 2021-00089; dated Jan. 2017; 5 pages.
McNelis et al.; High-Performance Plug-and-Perf Completions in Unconventional Wells; Society of Petroleum Engineers Annual Technical Conference and Exhibition; Sep. 28, 2015.
Norwegian Industrial Property Office; Office Action and Search Report for NO App. 20160017; dated Jun. 15, 2017; 5 pages.
Norwegian Industrial Property Office; Office Action and Search Report for NO App. No. 20171759; dated Jan. 14, 2020; 6 pages.
Norwegian Industrial Property Office; Office Action for NO Appl. No. 20171759; dated Oct. 30, 2020; 2 pages.
Owen Oil Tools; CORELAB ZERO180 Gun System Assembly and Arming Procedures; dated 2015-2020; 38 pages.
Parrot, Robert; Declaration, PGR 2020-00080; dated Aug. 11, 2020; 400 pages.
Parrott, Robert A.; Declaration in Support of PGR20201-00089; dated Jun. 1, 2021; 353 pages.
Parrott, Robert et al.; U.S. Appl. No. 60/286,907; dated Apr. 27, 2001; 24 pages.
Parrott, Robert et al.; U.S. Appl. No. 60/306,938; dated Jul. 20, 2001; 26 pages.
Parrott, Robert; Declaration for PGR No. 2021-00078; dated May 10, 2021; 182 pages.
Parrott, Robert; U.S. Appl. No. 60/307,086; dated Jul. 20, 2001; 15 pages.
Perf.com VaporGun; Exhibit No. 1021 of PGR No. 2021-00089; dated Aug. 6, 2020; http://www.perf.com/vaporgun; 4 pages.
Perforating Guns and Setting Tools; Exhibit 1015 of PGR No. 2021-00089; dated Dec. 2019; 33 pages.
Perforating Services Catalog 2008 part 1 of 2; Exhibit 1020 of PGR No. 2021-00089 dated 2008; 282 pages.
Perforating Services Catalog 2008 part 2 of 2; Exhibit 1020 of PGR No. 2021-00089; dated 2008; 239 pages.
Preiss Frank et al.; Lowering Total Cost of Operations Through Higher Perforating Efficiency while simultaneously enhancing safety; 26 pages.
Resilience Against Market Volatility Results Presentation; Exhibit 2015 of PGR No. 2020-00080; dated Jun. 30, 2020; 26 pages.
Robert Parrott, Case IPR2018-00600 for U.S. Pat. No. 9,581,422 B2, Declaration regarding Patent Invalidity, dated Jun. 29, 2020, 146 pages.
Rodgers, John; Declaration for PGR2020-00072; dated Oct. 23, 2020; 116 pages.
Rodgers, John; Declaration for PGR2020-00080; dated Nov. 18, 2020; 142 pages.
Patent Trial and Appeals Board; Decision Granting Institution of Post Grant Review, PGR No. PGR2021-00097; dated Jan. 6, 2022; 92 pages.
United States Patent and Trademark Office; Non-Final Office Action for U.S. Appl. No. 17/162,579; dated Feb. 28, 2022; 16 pages.
DynaEnergetics, DS NLine™ Oriented Perforating System, Precise Charge Alignment for Plug-and-Perf Operations, Jul. 18, 2019, 2 pgs., dynaenergetics.com.
DynaEnergetics, DS NLine™ System, Internal Frequently Asked Questions, Mar. 10, 2020, 4 pgs., dynaenergetics.com.
International Searching Authority; International Preliminary Report on Patentability of the International Searching Authority for PCT/EP2020/086496; dated Jun. 30, 2022; 9 pages.

* cited by examiner

MODULAR PERFORATING GUN SYSTEM

CROSS-REFERENCE TO RELATED APPLICATIONS

This application claims the benefit of U.S. Provisional Patent Application No. 63/031,339 filed May 28, 2020. This application claims the benefit of U.S. Provisional Patent Application No. 62/949,016 filed Dec. 17, 2019. Each application listed above is incorporated herein by reference in its entirety.

BACKGROUND OF THE DISCLOSURE

Hydrocarbons, such as fossil fuels (e.g. oil) and natural gas, are extracted from underground wellbores extending deeply below the surface using complex machinery and explosive devices. Once the wellbore is established by placement of casing pipes after drilling and cementing the casing pipe in place, a perforating gun assembly, or train or string of multiple perforating gun assemblies, are lowered into the wellbore, and positioned adjacent one or more hydrocarbon reservoirs in underground formations.

Assembly of a perforating gun may require assembly of multiple parts. Such parts typically include a housing or outer gun barrel containing or connected to perforating gun internal components such as: an electrical wire for relaying an electrical control signal such as a detonation signal from the surface to electrical components of the perforating gun; an electrical, mechanical, and/or explosive initiator such as a percussion initiator, an igniter, and/or a detonator; a detonating cord; one or more explosive and/or ballistic charges which are held in an inner tube, strip, or other carrying device; and other known components including, for example, a booster, a sealing element, a positioning and/or retaining structure, a circuit board, and the like. The internal components may require assembly including connecting electrical components within the housing and confirming and maintaining the connections and relationships between internal components. The assembly procedure may be difficult within the relatively small free space within the housing. Typical connections may include connecting the electrical relay wire to the detonator or the circuit board, coupling the detonator and the detonating cord and/or the booster, and positioning the detonating cord in a retainer at an initiation point of each charge.

The housing may also be connected at each end to a respective adjacent wellbore tool or other component of the tool string such as a firing head and/or a tandem seal adapter or other sub assembly. Connecting the housing to the adjacent component(s) typically includes screwing the housing and the adjacent component(s) together via complementary threaded portions of the housing and the adjacent components and forming a connection and seal therebetween.

Known perforating guns may further include explosive charges, typically shaped, hollow, or projectile charges, which are initiated, e.g., by the detonating cord, to perforate holes in the casing and to blast through the formation so that the hydrocarbons can flow through the casing. In other operations, the charges may be used for penetrating just the casing, e.g., during abandonment operations that require pumping concrete into the space between the wellbore and the wellbore casing, destroying connections between components, severing a component, and the like. The exemplary embodiments in this disclosure may be applicable to any operation consistent with this disclosure. For purposes of this disclosure, the term "charge" and the phrase "shaped charge" may be used interchangeably and without limitation to a particular type of explosive, charge, or wellbore operation, unless expressly indicated.

The perforation guns may be utilized in initial fracturing process or in a refracturing process. Refracturing serves to revive a previously abandoned well in order to optimize the oil and gas reserves that can be obtained from the well. In refracturing processes, a smaller diameter casing is installed and cemented in the previously perforated and accessed well. The perforating guns must fit within the interior diameter of the smaller diameter casing, and the shaped charges installed in the perforating guns must also perforate through double layers of casing and cement combinations in order to access oil and gas reserves.

The explosive charges may be arranged and secured within the housing by the carrying device which may be, e.g., a typical hollow charge carrier or other holding device that receives and/or engages the shaped charge and maintains an orientation thereof. Typically, the charges may be arranged in different phasing, such as 60°, 120°, 180°, etc. along the length of the charge carrier, so as to form, e.g., a helical pattern along the length of the charge carrier. Charge phasing generally refers to the radial distribution of charges throughout the perforating gun, or, in other words, the angular offset between respective radii along which successive charges in a charge string extend in a direction away from an axis of the charge string. An explosive end of each charge points outwardly along a corresponding radius to fire an explosive jet through the gun housing and wellbore casing, and/or into the surrounding rock formation. Phasing the charges therefore generates explosive jets in a number of different directions and patterns that may be variously desirable for particular applications. On the other hand, it may be beneficial to have each charge fire in the same radial direction. A charge string in which each charge fires in the same radial direction would have zero-degree (0°) phasing.

Once the perforating gun(s) is properly positioned, a surface signal actuates an ignition of a fuse or detonator, which in turn initiates the detonating cord, which detonates the explosive charges to penetrate/perforate the housing and wellbore casing, and/or the surrounding rock formation to allow formation fluids to flow through the perforations thus formed and into a production string.

Known perforating guns suffer from shortcomings with respect to achieving the potential benefits of adaptable charge phasing. For example, metal charge tubes and other charge carriers that are not easily reconfigurable are not easily adaptable for use with different numbers of charges in different phasing. The number and phasing of charges in such rigid carriers may be limited by the number and orientation of charge holes/receivers in the particular charge carrier. Machining different charge carriers for every possible desired arrangement and number of charges in the perforating gun is not practically desirable.

In addition, a charge carrier that provides a very high charge phasing (i.e., a relatively severe angle between successive charges in the charge carrier) requires that a detonating cord make relatively drastic bends, especially for charges arranged with a relatively short distance between them, as it is routed between the initiating end of successive shaped charges. The detonating cord must be precisely positioned on the initiating end, above an initiation point, of the shaped charge to ensure that the detonating cord initiates detonation of the shaped charge. The detonating cord is retained at the initiation point of the shaped charge by a variety of known detonating cord retaining components. Typically, the forces and stresses on the detonating cord, especially at the detonating cord retaining components, increases as the phasing increases and the distance decreases between successive charges. The forces and stresses may damage the detonating cord and/or cause the detonating cord to become misaligned with the initiation point either to a side of the initiation point or in a direction away from the initiation point in which the detonating cord is pulling away from the retaining component.

In certain known systems, such as shown in FIG. 7-9, an assembly 10 of shaped charges 18 in individual, stackable charge holders 16 is shown as described in U.S. Pat. No. 10,472,938 issued Nov. 12, 2019, which is commonly owned by DynaEnergetics Europe GmbH and incorporated by reference herein in its entirety. With reference to FIG. 7, the shaped charges 18 are arranged with approximately 60° phasing.

With reference now to FIGS. 8 and 9, opposing end views a single stackable charge holder 16 as shown in the assembly of FIG. 7 is shown. As shown in FIG. 8, the charge holder 16 includes a plurality of pins 50 extending from a first base 222 on a male side 45 of the charge holder 16. As shown in FIG. 9, the charge holder 16 includes a plurality of sockets 52 that extend at least partially into a second base 224 on a female side 60 of the charge holder 16. Connecting adjacent stackable charge holders 16 to each other in a particular phasing includes arranging a first charge holder and a second charge holder such that the male side 45 of the first charge holder is opposite the female side 60 of the second charge holder and rotating the first and second charge holders relative to each other to the desired phasing of the shaped charges contained therein. Once the desired phasing is reached, pins 50 are inserted into aligned sockets 52 at the particular phasing to set the phasing of the charge holders/shaped charges and/or lock the adjacent charge holders together. The adjacent charge holders may be locked by, for example, inserting areas of expanded diameter (i.e., "mushroom tops" (not shown)) on the top of one or more pins 50 into the sockets 52, to establish positive locking therebetween.

While the assembly 10 and shaped charge holders 16 shown in FIGS. 7-9 are beneficial for providing a variety of different phasing in which the charge holders 16 may be oriented, certain challenges with such a system include, for example, the need to mold or machine relatively miniscule pins 50 with surface features such as, e.g., the mushroom tops previously discussed, to allow positive locking with the sockets 52. Forming such geometries on very small components such as the pins 50 shown in FIG. 8 is time consuming, among other things. In addition, while the substantially continuous rings of pins 50 and sockets 52 around the respective first base 222 and second base 224 allow for many possible phasing options, it can be difficult or time consuming to verify that the correct phasing has been achieved when connecting the adjacent charge holders because the phasing is difficult to determine by eye and connecting the charge holders off by one or two pin 50/socket 52 positions will not result in the proper phasing. For the same reasons, the substantially continuous rings of pins 50 and sockets 52 creates challenges for automating the assembly of the charge holders 16.

Accordingly, a modular perforating gun system that addresses the above challenges would be beneficial.

BRIEF DESCRIPTION OF THE EXEMPLARY EMBODIMENTS

In an aspect, the disclosure relates to a modular, stackable charge holder for a perforating gun assembly. The shaped charge holder may comprise a base portion, a shaped charge receiving portion formed in the base portion for receiving a shaped charge, a retention socket extending from the base portion adapted to receive and retain a detonating cord, and a male connector end arranged on one side of the base portion for receiving a corresponding female connector end of a first other component. The shaped charge holder may further comprise a female connector end arranged on a second side of the base portion opposite the first side of the base portion for receiving a corresponding male connector end of a second other component. In an aspect, the retention socket may comprise oppositely disposed retention arms that form a receptacle for the detonating cord, and each oppositely disposed retention arm may have at least one corresponding shaped sidewall portion and a corresponding flange extending transversely from a top section of the retention arm. The shaped sidewall portions may be adapted to abut against the detonating cord when the detonating cord is routed from the charge holder to one of the first and second other components. In an aspect, the shaped sidewall portions may be resilient and counteract forces exerted by the detonating cord on one or both of the sidewall portions, thereby locking the detonating cord in place.

In another aspect, the disclosure relates to a connector system for connecting components of a perforating gun assembly. The connector system may comprise a male connector end arranged on a first side of a first component and a female connector end arranged on a first side of a second component adapted to positively connect to the male connector end of the first component. The male connector end may comprise a centrally oriented knob connector and at least one phasing protrusion spaced apart from the knob connector, and the female connector end may comprise a central bore and a plurality of spaced-apart phasing holes surrounding the central bore. The male connector end of the first component may be adapted to interconnect with the female connector end of the second component at various phase angles corresponding to the phasing holes.

In another aspect, the disclosure relates to a modular perforation gun assembly. The modular perforating gun assembly may comprise a housing, a detonating cord, a first modular component comprising a detonator holder, and at least one second modular component. The second modular component may comprise at least one stackable charge holder connected at a first end to the detonator holder, and each of the at least one stackable charge holders may be adapted for centralizing a shaped charge within the housing. The modular perforating system may further comprise a third modular component. The third modular component may comprise a cord terminator connected to a second end of the at least one stackable charge holder, for terminating the detonating cord. The modular perforating gun assembly may further comprise a connector system for connecting the modular components of a perforating gun assembly, and the connector system may comprise a male connector end and a female connector end adapted to positively connect to the male connector end. Each of the modular components may comprise at least one of the male connector end and the female connector end. The male connector end may comprise a centrally oriented knob connector and at least one phasing protrusion spaced apart from the knob connector, and the female connector end may comprise a central bore and a plurality of spaced-apart phasing holes surrounding the central bore. The male connector end of the first component may be adapted to interconnect with the female connector end of the second component at various phase angles corresponding to the phasing holes.

BRIEF DESCRIPTION OF THE DRAWINGS

A more particular description will be rendered by reference to exemplary embodiments that are illustrated in the accompanying figures. Understanding that these drawings depict exemplary embodiments and do not limit the scope of this disclosure, the exemplary embodiments will be described and explained with additional specificity and detail through the use of the accompanying drawings in which.

Figure 1:
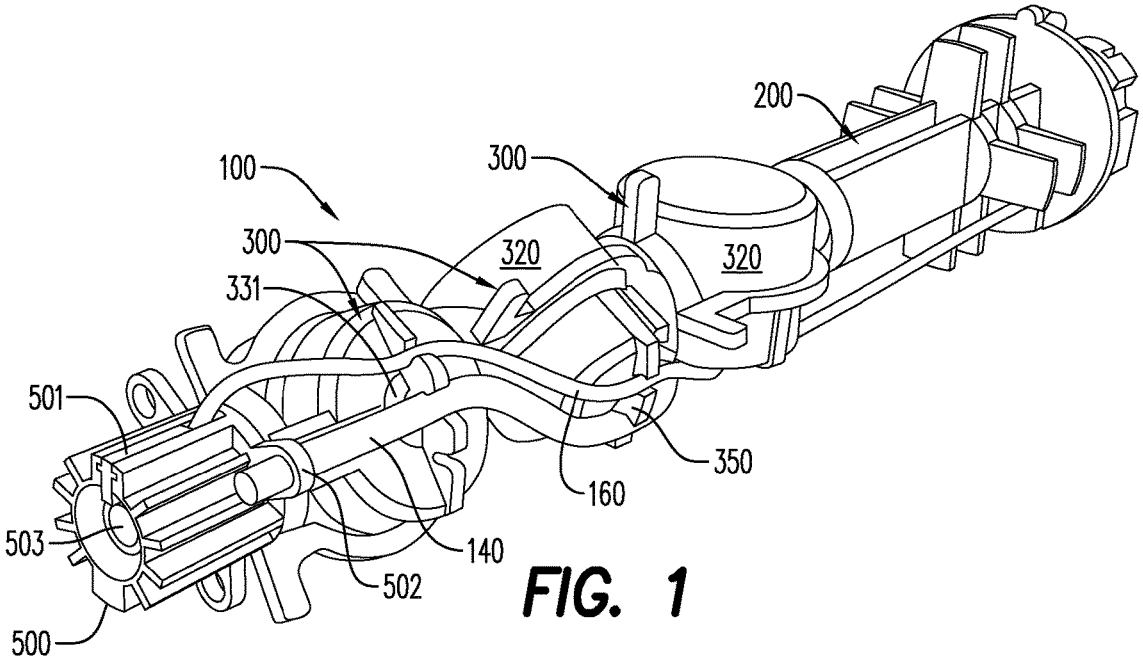
FIG. 1 shows a modular perforating gun assembly according to an exemplary embodiment.

Various features, aspects, and advantages of the exemplary embodiments will become more apparent from the following detailed description, along with the accompanying drawings in which like numerals represent like components throughout the figures and detailed description. The various described features are not necessarily drawn to scale in the drawings but are drawn to aid in understanding the features of the exemplary embodiments.

The headings used herein are for organizational purposes only and are not meant to limit the scope of the disclosure or the claims. To facilitate understanding, reference numerals have been used, where possible, to designate like elements common to the figures.

DETAILED DESCRIPTION

Reference will now be made in detail to various exemplary embodiments. Each example is provided by way of explanation and is not meant as a limitation and does not constitute a definition of all possible embodiments.

Figure 2:
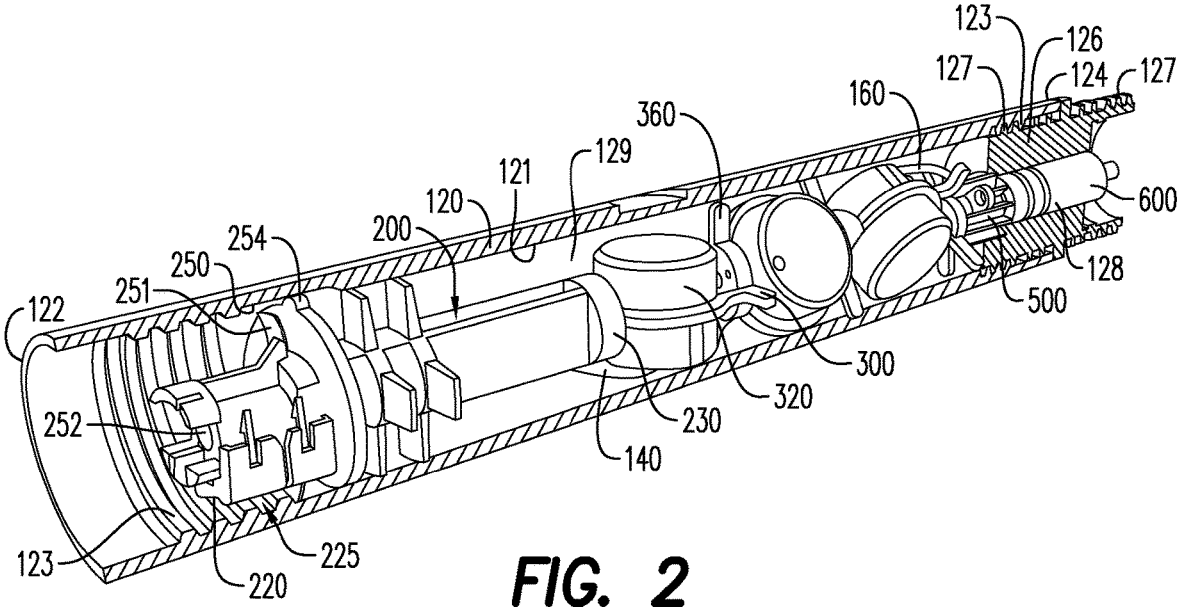
FIG. 2 shows a cross section of a perforating gun assembly according to an exemplary embodiment.

With reference to FIGS. 1 and 2, the exemplary embodiments relate generally to a modular perforating gun assembly 100. The perforating gun assembly 100 may be used in various wellbore applications, such as re-fracturing (dual casing string) applications. According to an aspect, the modular perforating gun assembly 100 may be designed to have a maximum outer diameter of 3-inches, and in some embodiments of 2.5-inches, without limitation. The perforating gun assembly 100 includes a plurality of components connected together using, e.g., brick-and-knob and other affirmative-locking connectors and is positioned within a perforating gun housing 120. Various components may be injection molded and may require use of up to about 50% less raw injection molding material than known injection-molded perforating gun assemblies.

The exemplary perforating gun assembly 100 includes, among other things, a detonator holder 200, a plurality of shaped charge holders 300, and a cord terminator 500. FIG. 1 depicts an assembled configuration of the detonator holder 200, the plurality of shaped charge holders 300 with a respective shaped charge 320 received in each shaped charge holder 300, and the cord terminator 500, prior to the assembled components being positioned in the perforating gun housing 120. A detonating cord 140 for detonating the shaped charges 320 extends (FIG. 3B) from the detonator holder 200 (where, in operation, it is initiated by a detonator (not shown) within a central bore 252 (FIG. 2) of the detonator holder 200) to a detonating cord terminator 502 on the cord terminator 500. In the exemplary embodiment illustrated in FIGS. 1 and 2, the shaped charge holders 300 are arranged with a phasing that is greater than zero such that the detonating cord 140 extends in a helical path 'a' (FIG. 4H) to meet each shaped charge 320 at an initiation end 331 of each shaped charge 320. The detonating cord 140 is held in place at each initiation end 331 by a respective cord retention socket 350 including a detonating cord receptacle 351 (FIG. 4K) on each shaped charge holder 300.

A through wire 160 extends between a line out connection of the detonator in the detonator holder 200 to a through wire positioner 501 on the cord terminator 500, for relaying an electrical signal, such as a selective detonation signal, from a line out of the detonator (or another electrical connection or relay) to an electrical connection to a detonator, or an electrical relay or the like, in an adjacent perforating gun assembly or wellbore tool. In an exemplary embodiment, the perforating gun assembly 100 may include an intrinsically safe, wire-free, integrated switch (selective) detonator, for example, as described in U.S. Pat. No. 9,605,937 issued Mar. 28, 2017, which is commonly owned by DynaEnergetics Europe GmbH and incorporated by reference herein in its entirety to the extent consistent with this disclosure. In other embodiments, the detonator may be any known detonator or detonator assembly, or may generally be an initiator, i.e., a device for ballistically, explosively, or pyrotechnically initiating a detonating cord and/or an explosive charge, including, for example, an igniter or a booster, consistent with this disclosure. For purposes of this disclosure, the term "detonator" includes such detonators, detonator assemblies, and initiators generally.

The through wire 160 may, without limitation, connect directly or via an intervening contact to a line out contact of the detonator within the central bore 252 of the detonator holder 200, at a detonator contact area 225 of the detonator holder 200, and relay an electrical signal from the line out contact to an electrical transfer contact 503 positioned on the cord terminator 500 and configured for making electrical contact with a feedthrough bulkhead 600 positioned within a tandem seal adapter 126 adjacent the perforating gun assembly 100 at a second end 124 of the housing 120. In an aspect, the tandem seal adapter 126 may connect to an adjacent wellbore tool, such as another perforating gun, and the feedthrough bulkhead 600 may relay the electrical signal to an electrical component, contact, relay, or the like in the adjacent wellbore tool. The electrical feedthrough via the through wire 160 and the feedthrough bulkhead 600 allows, without limitation, a selective detonation signal to be relayed to each respective selective detonator/initiator in successive wellbore tools and selectively, individually initiate a particular detonator/initiator using a digital code unique to the particular detonator/initiator.

In an aspect, the feedthrough bulkhead 600 may include, without limitation, wireless pin contacts between and in electrical contact with each of the through wire 160 (e.g., via the electrical transfer contact 503) in the through wire positioner 501 and, e.g., a line in contact for a detonator/initiator in an adjacent wellbore tool. The feedthrough bulkhead 600 may be positioned and form a seal within a through bore 128 within the tandem seal adapter 126. The feedthrough bulkhead 600 may pressure seal an interior 129 of the housing 120, within which the perforating gun assembly 100 is positioned, to prevent pressures generated by the detonation of the shaped charges 320 from damaging adjacent wellbore tools.

FIG. 2 shows the exemplary perforating gun assembly 100 arranged in the housing 120. The housing has a first end 122 opposite the second end 124. The first end 122 and the second end 124 may each be configured as female ends, i.e., having internal threading 123 to facilitate the connection between adjacent housings (not shown) via the tandem seal adapter 126 having the bulkhead assembly 600 secured therein. The tandem seal adapter 126 may have external threads 127 on each of two opposite sides as is well known, such that the tandem seal adapter 126 may connect to the internal threading 123 on opposing ends of adjacent wellbore tools, such as the second end 124 of the perforating gun housing 120 and a first end (i.e., 122) of an adjacent perforating gun housing, to seal the internal areas and components of the wellbore tools from wellbore fluids and other materials in the wellbore. Alternatively, one of the first end 122 of the housing 120 and the second end 124 of the housing 120 may be configured as a male end, i.e., including external threads on an outer surface of the housing 120, while the other end is a female end, such that one perforating gun assembly housing may attach directly to an adjacent perforating gun assembly housing without requiring a tandem seal adapter. In such embodiment, the bulkhead may, for example and without limitation, be secured within a bore through the male end of the housing 120. In other embodiments, both the first end 122 and the second end 124 of the housing 120 may be configured as a male end or a female end, and a corresponding tandem seal adapter for use with such embodiments would include corresponding connections on each end of the tandem seal adapter.

For purposes of this disclosure, reference(s) to a perforating gun or a string of perforating guns for use with the exemplary embodiments of a perforating gun assembly are not limiting. Other wellbore tools as are known in the art may be used in conjunction with the exemplary embodiments and/or aspects thereof, to the extent that they are consistent with this disclosure.

Figure 3A:
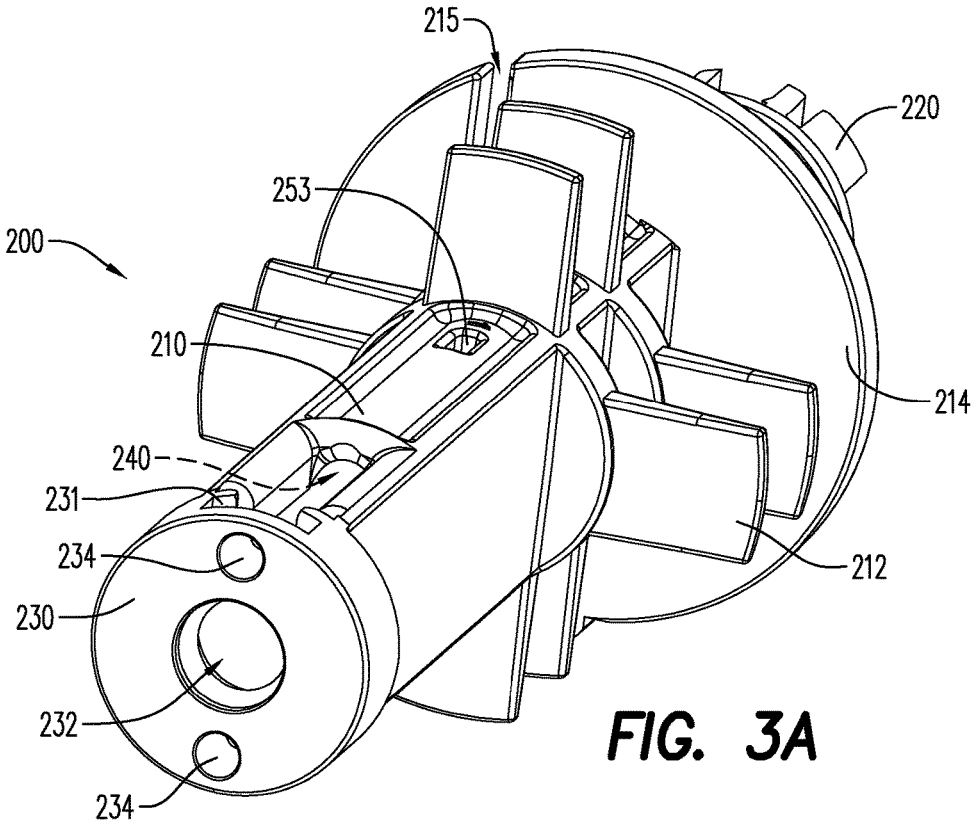
FIG. 3A shows a perforating gun detonator holder according to an exemplary embodiment.
Figure 3B:
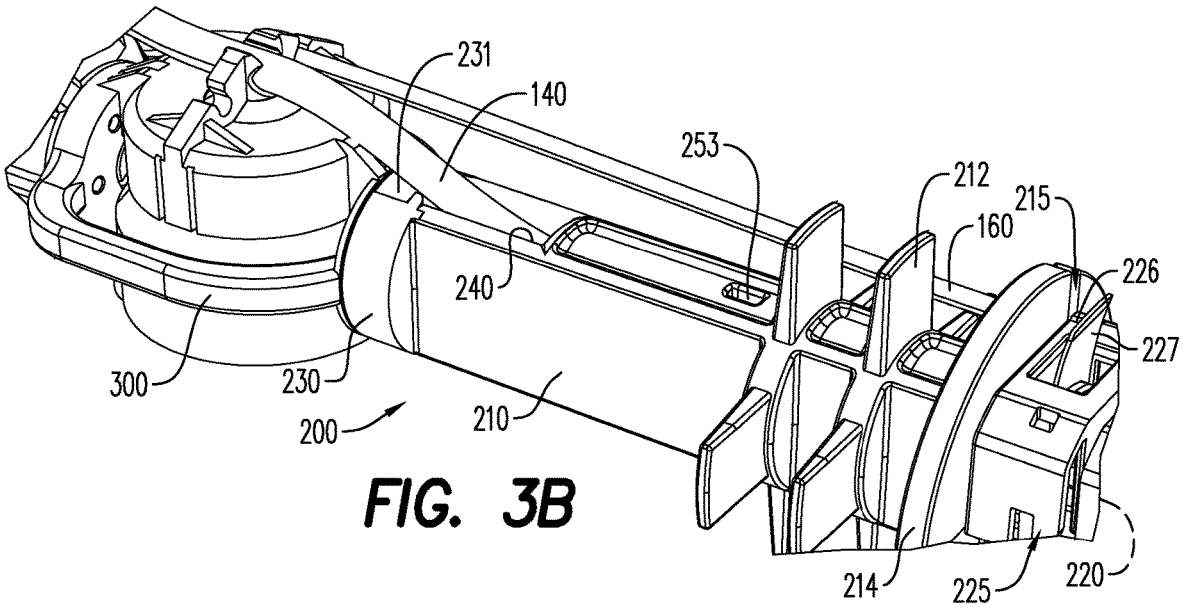
FIG. 3B shows the exemplary perforating gun detonator holder of FIG. 3A in a portion of a modular perforating gun assembly, according to an exemplary embodiment.

With continuing reference to FIG. 2, and further reference to FIG. 3A and FIG. 3B, the detonator holder 200 according to an exemplary embodiment may include one or more ribs 212 and a blast plate 214 extending radially outwardly from an elongated body 210 of the detonator holder 200. The ribs 212 and plate 214 may be configured substantially as the ribs and plate described in U.S. Pat. No. 10,458,213 issued Oct. 29, 2010, which is commonly owned by DynaEnergetics Europe GmbH and incorporated herein by reference in its entirety to the extent consistent with this disclosure. Each of the ribs 212 and the plate 214 may aid in centering and positioning the detonator holder 200 in place within the housing 120 during and after inserting the perforating gun assembly 100 in the housing 120. The ribs 212 may abut an interior surface 121 of the housing 120. The plate 214 may be circularly shaped and include a detent 254 on its circumference. The detent 254 may engage a complimentary slot 250 formed in the interior surface 121 of the housing 120, to aid in guiding, centering, and preventing rotation of the detonator holder 200 within the housing 120. The plate 214 may provide further protection for an adjacent perforating gun, by acting as a barrier to the blast and debris created by detonation of the shaped charges 320. The blast plate 214 may include a slot 215 configured to receive the through wire 160 therethrough, and retain and align the through wire 160 with a through wire connection port 226 into which the through wire 160 is inserted to make contact with a through wire connector 227 that wirelessly electrically connects the line out contact of the detonator with the through wire 160. The slot 215 may also help to route the through wire 160 along at least a portion of the length of the perforating gun assembly 100.

A ground bar 251 extends outwardly from the detonator holder 200 between the central bore 252 of the detonator holder 200 and the interior surface 121 of the housing 120. The ground bar 251 grounds the detonator to one or more of the perforating gun housing 120, a tandem seal adapter (i.e., at the first end 122 of the housing 120), or an adjacent perforating gun housing. The ground bar 251 may be configured for contacting one or more of the interior surface 121 of the housing 120, the tandem seal adapter in the first end 122 of the housing 120, or the adjacent perforating gun housing (e.g., in embodiments in which adjacent perforating gun housings are connected directly to each other via opposing male and female ends). The ground bar 251 and the detonator holder 200 and central bore 252 are together configured for electrically connecting (e.g., by contact) the ground bar 251 to a ground portion of the detonator, when the detonator is inserted in the central bore 252.

The body 210 of the detonator holder 200 has a detonator receiving end 220 at which the central bore 252 of the detonator holder 200 is open, and a female connector end 230 opposite and spaced apart from the detonator receiving end 220. The central bore 252 is generally an elongated opening extending along at least a portion of an interior of the detonator holder body 210 between the detonator receiving end 220 and the female connector end 230. The female connector end 230 includes a centrally arranged hole 232 and at least two additional phasing holes 234 spaced apart from the centrally arranged hole 232. The female connector end 230 of the detonator holder may include an undercut area 231, configured as a chamfer or a slit that serves as a positive undercut to facilitate a locking action between the detonator holder 200 and other components, such as a charge holder 300 (FIG. 3B). The positive undercut is particularly useful for receiving a knob connector of, for example, the charge holder 300 and may also help to route the detonating cord 140 towards a chamber 240 (discussed below) in the detonator holder body 210.

The chamber 240 is generally a cutout formed in a side portion of the detonator body 210 and generally extends from the female connector end 230 towards the detonator receiving end 220 within the interior of the detonator holder body 210. At least a portion of the chamber 240 may be parallel to a portion of the central bore 252 within the detonator holder body 210. The chamber 240 is, in one or more areas within the detonator holder body 210, in open communication with the central bore 252, to ensure that a portion of an externally directed detonating cord (the detonating cord 140) can be routed into a portion of the central bore 252 and/or placed in sufficient ballistic proximity to a detonator within the central bore 252 such that the detonator will initiate the detonating cord 140.

As illustrated in FIG. 3B, the chamber 240 is configured to receive a first end of the detonating cord 140 and secure the first end of the detonating cord 140 within the interior (e.g., the central bore 252) of the detonator holder body 210. This helps the detonator holder 200 to focus the detonation energy supplied by the detonator towards the detonating cord 140 to increase initiation reliability. According to an aspect, a window 253 is positioned above the chamber 240 and provides visibility into the chamber 240. The window 253 may be a slot or aperture formed through the detonator holder body 210, between the chamber 240 and an outside of the detonator holder 200. The window 253 may be configured to allow an installer or a user of the detonator holder 200 to confirm that the detonating cord 140 is positioned in or adjacent to the central bore 252 and is properly aligned with the detonator to reliably initiate the detonating cord 140.

Figure 4A:
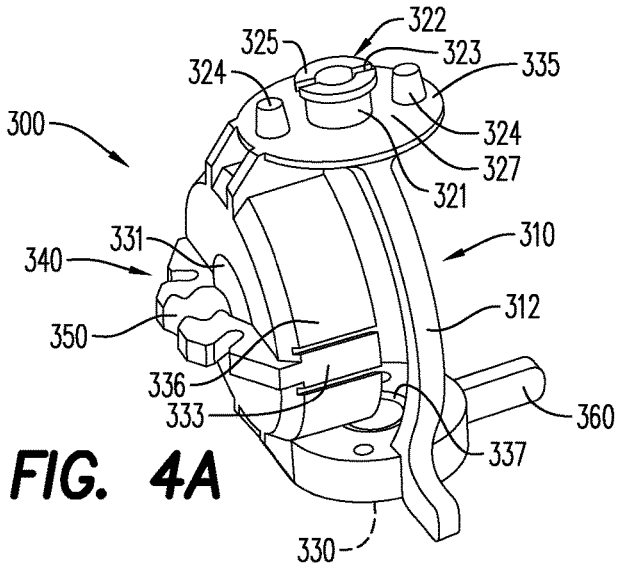
FIG. 4A shows a perspective view of a shaped charge holder according to an exemplary embodiment.
Figure 4B:
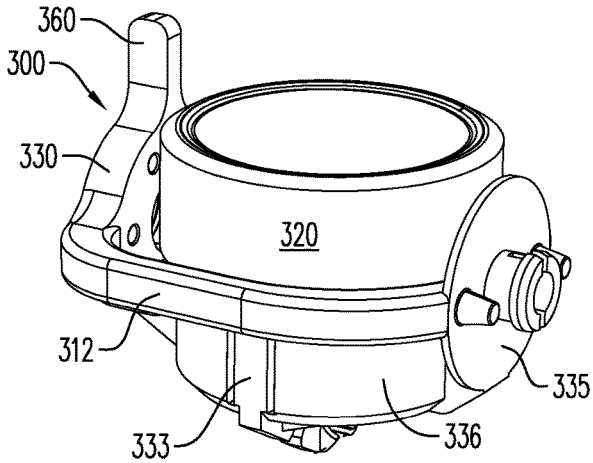
FIG. 4B shows a perspective view of the shaped charge holder of FIG. 4A.
Figure 4C:
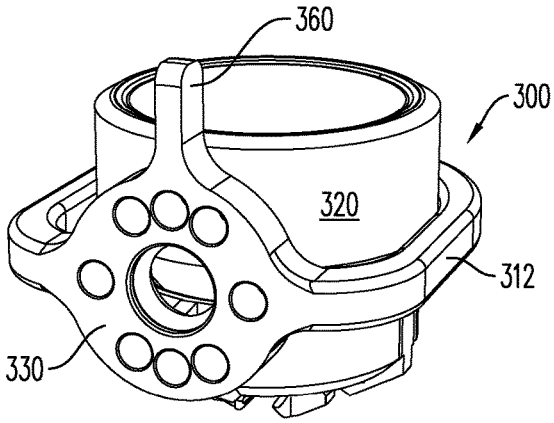
FIG. 4C shows a perspective view of the shaped charge holder of FIG. 4A.

An exemplary shaped charge holder 300 is illustrated in FIGS. 4A-4D. The shaped charge holder 300 includes a shaped charge receiving portion 310, a male connector end 335 and a female connector end 330. The shaped charge receiving portion 310 includes a snap-in/click-in connection 333 (i.e., a positive locking mechanism) for the shaped charge 320. Such a positive locking mechanism 333 may be a positive locking mechanism as described in U.S. Pat. No. 10,458,213 issued Oct. 29, 2019, which is commonly owned by DynaEnergetics Europe GmbH and incorporated herein by reference in its entirety to the extent consistent with this disclosure. With additional reference to FIG. 4G, the shaped charge receiving portion 310 may be configured as an opening through one or more arms 312 and a complimentary depression 328 in a base portion 336 of the shaped charge holder 300. An inner surface of the depression 328 of the charge receiving portion 310 may include a plurality of geometric contours 329 for providing added stability to the charge holder 300. In addition, the geometric contours 329 facilitate the use of less raw injection molding material and results in decreased mass for the charge holder 300. The arms 312 of the shaped charge holder 300 may be configured to guide, stabilize and/or secure the shaped charge 320 within the shaped charge receiving portion 310.

In an aspect, the shaped charge holder 300 may include a spacing projection 360 extending away from, e.g., the female connector end 330 in the radial direction in which the shaped charge 320 extends from the base portion 336 of the charge holder 300. The spacing projection 360 may serve to guide the shaped charge 320 into the housing 120 during assembly and/or prevent the shaped charge 320 from contacting the interior surface 121 of the housing 120 and sustaining damage therefrom.

The male connector end 335 of the charge holder 300 (FIGS. 4A-4B) according to the exemplary embodiment includes a centrally oriented, bifurcated knob connector 322 and at least one phasing protrusion 324 spaced apart from the centrally oriented knob connector 322. The centrally oriented knob connector 322 includes a slit 323 formed in its body, e.g., from an end face 325 of the knob connector 322 through at least a portion of a cylindrical extension 321 of the knob connector 322. The slit 323 bifurcates the knob connector 322 along the length to which it extends. For example, with reference to the exemplary embodiment(s) shown in FIGS. 4K and 4L, the slit 323 extends from the end face 325 of the knob connector 322 to a connector face 327 of the male connector end 335. The phasing protrusion(s) 324 may be funnel shaped. According to an aspect, the centrally oriented knob connector 322 and two phasing protrusions 324 may be arranged along a diameter of the connector face 327.

The female connector end 330 of the charge holder 300 includes a centrally arranged hole 332 and a plurality of phasing holes 334 spaced apart from the centrally arranged hole 332 and from each other. The male connector end 335 of a first shaped charge holder 300 is configured to be received and secured in the female connector end 330 of another or a second shaped charge holder 300. The centrally oriented knob connector 322 may be secured in the centrally arranged hole 332 in such a configuration that a positive locking between the first and second shaped charge holders is achieved.

Figure 4D:
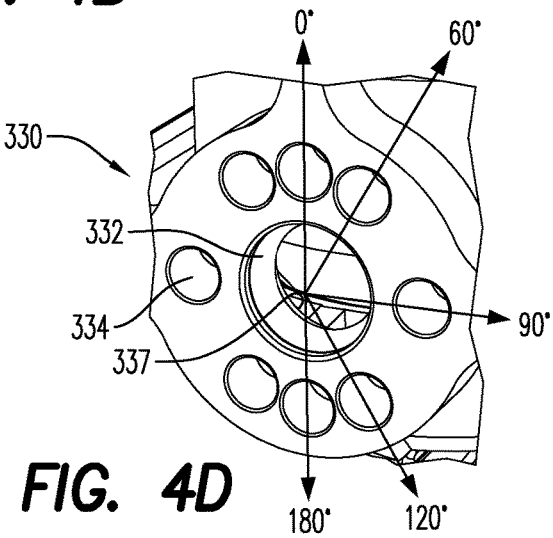
FIG. 4D shows a female connector end of the shaped charge holder of FIG. 4A.

According to an aspect, and as illustrated in FIG. 4D, the phasing holes 334 of the shaped charge holder 300 are arranged to facilitate 60-, 90-, 120-, and 180-degree phasing of the shaped charge holder 300 (and thereby a shaped charge 320 received therein) depending on the particular phasing holes 334 into which the phasing protrusions 324 are inserted. The shaped charges 320 may be optimally configured to perforate through multiple casings cemented in a wellbore, including the cement, and ultimately into a hydrocarbon formation. The exemplary configuration(s) of the phasing holes 334 shown in FIG. 4D may enable the use of an optical alignment system to confirm proper alignment and phasing of a plurality of shaped charge holders 300 of a perforating gun system. FIG. 4D illustrates examples of the particular phasing that may be accomplished by shaped charges of the configurations described herein.

Figure 4E:
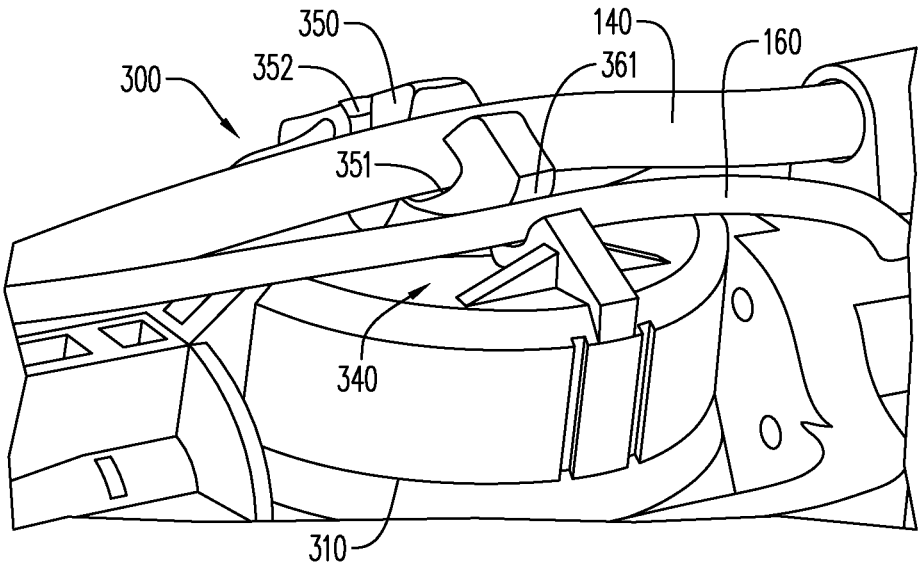
FIG. 4E shows the exemplary shaped charge holder of FIG. 4A in a portion of a modular perforating gun assembly, according to an exemplary embodiment.

According to an aspect and as illustrated in FIG. 4A and FIG. 4E, a rear portion 340 of the shaped charge holder 300, opposite the shaped charge receiving portion 310, includes the retention socket 350. The retention socket 350 may extend from or be integrally formed on an outer surface of the base portion 336. According to an aspect, the retention socket 350 comprises a depression/indentation configured as the detonating cord receptacle 351 and a depression/indentation configured as a through wire receptacle 361, and may include an additional depression/indentation configured as a secondary receptacle 352 for, e.g., arranging the through wire 160 on an opposite side of the charge holder 300 according to the phasing of the charge holder 300 and successive components.

Figure 4F:
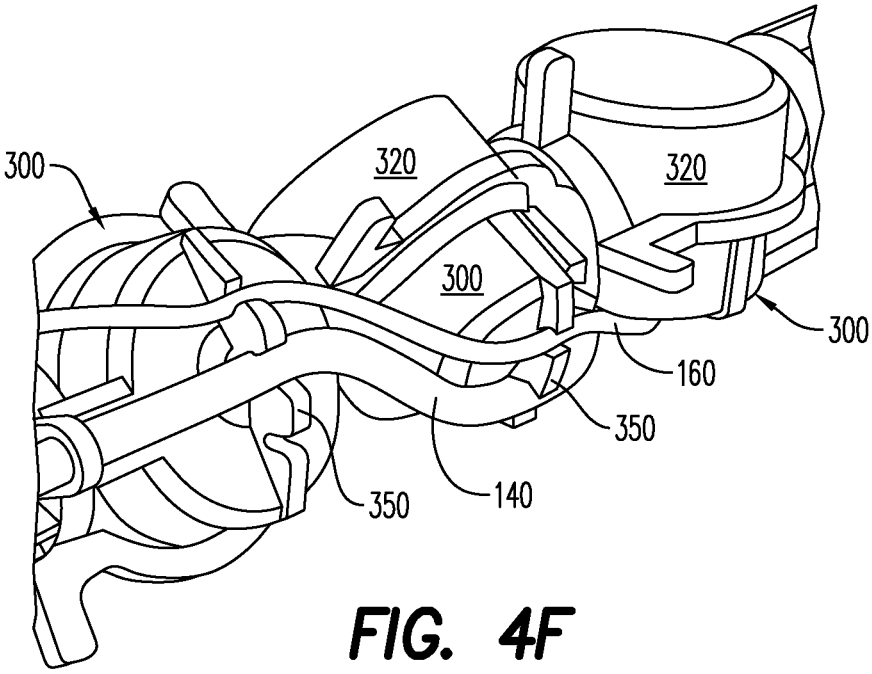
FIG. 4F shows interconnected shaped charge holders in a portion of a modular perforating gun assembly, according to an exemplary embodiment.
Figure 4G:
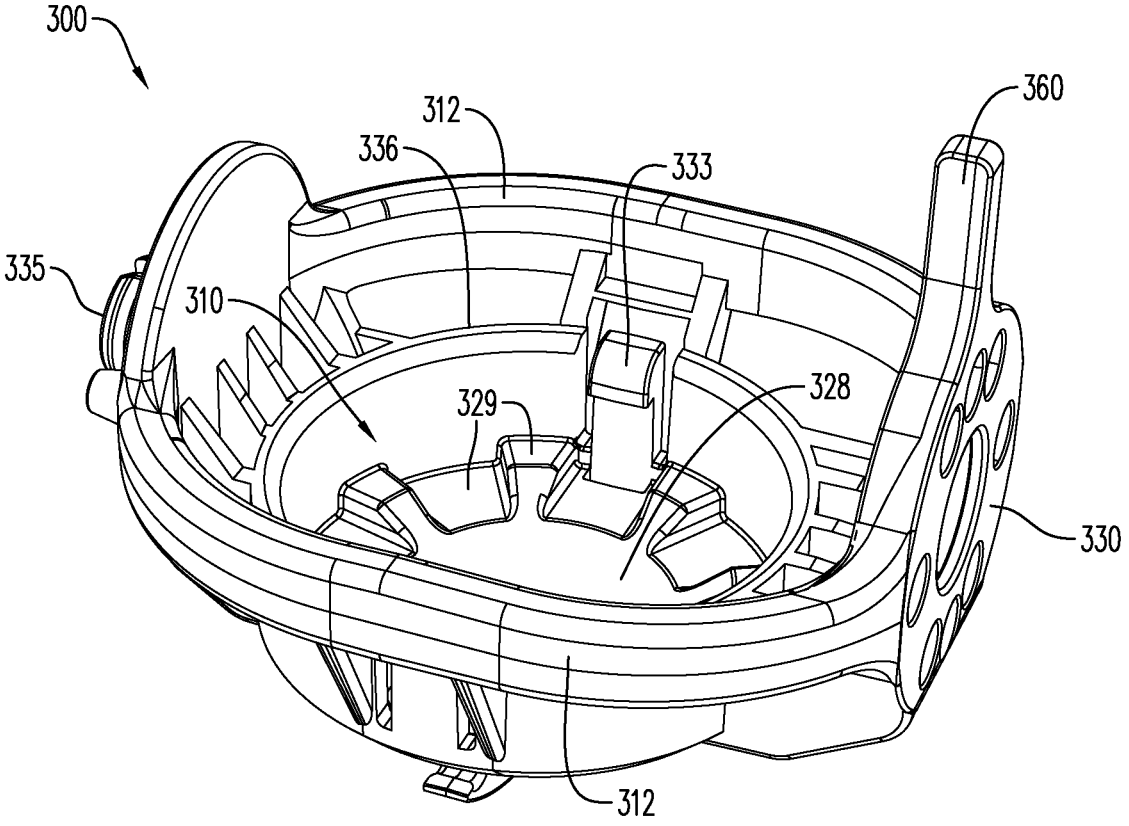
FIG. 4G shows a perspective view of the shaped charge holder of FIG. 4A.
Figure 4H:
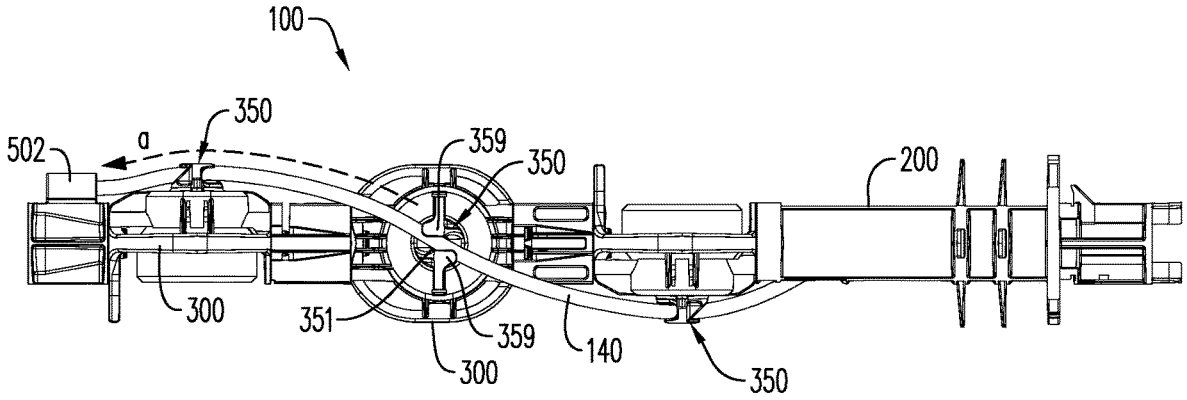
FIG. 4H shows interconnected shaped charge holders in a modular perforating gun assembly, according to an exemplary embodiment.
Figure 4I:
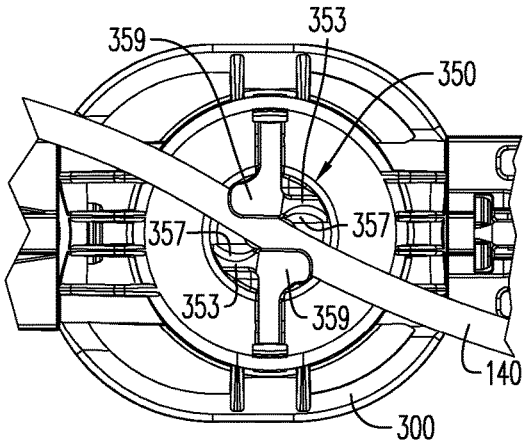
FIG. 4I shows a retention socket of a shaped charge holder, according to an exemplary embodiment.
Figure 4J:
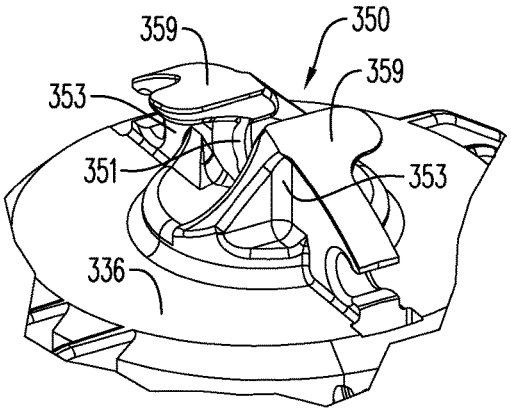
FIG. 4J shows a perspective view of a retention socket, according to an exemplary embodiment.
Figure 4K:
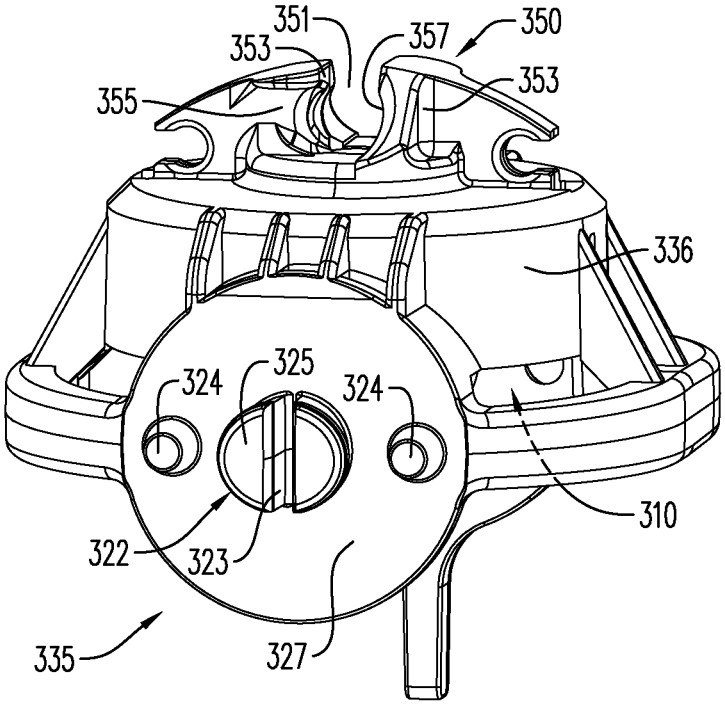
FIG. 4K shows a perspective view of a shaped charge holder and retention socket, according to an exemplary embodiment.

In an aspect of the exemplary embodiment shown in FIG. 4E, the shaped charge holder 300 includes a detonating cord receptacle 351 and a through wire receptacle 361 for respectively holding the detonating cord 140 and the through wire 160, and a secondary receptacle 352. The indentation(s) that form the detonating cord receptacle 351, the through wire receptacle 361, and the secondary receptacle 352 are inwardly facing, i.e., with an open end on a portion furthest from the shaped charge holder 300, so that they can be accessed from the outside of the shaped charge holder 300. According to an aspect the indentation may be U-shaped or inverse-omega (Ʊ)-shaped to further aid in retaining a cord/wire therein. As seen in FIG. 4A and FIG. 4E for example, the retention socket 350 may include a centrally oriented Ʊ—shaped indentation as the detonating cord receptacle 351 flanked by two Ʊ-shaped indentations as the through wire receptacle 361 and the secondary receptacle 352. FIG. 4E and FIG. 4F illustrate a detonating cord 140 and a through wire 160 being secured in the retention socket 350 and being routed along a length of a perforating gun assembly 100.

Figure 5A:
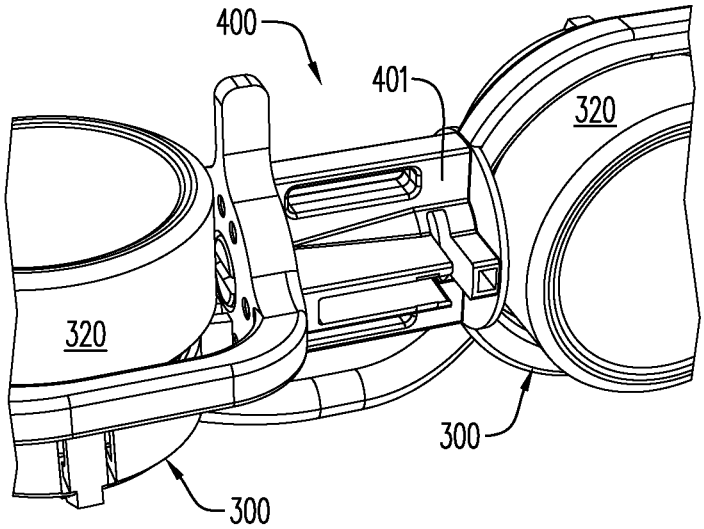
FIG. 5A shows a spacer in a portion of a modular perforating gun assembly, according to an exemplary embodiment.
Figure 5B:
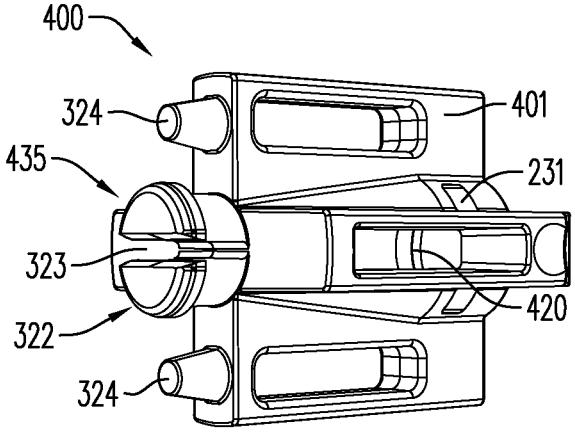
FIG. 5B shows a perspective view of a spacer according to an exemplary embodiment.
Figure 5C:
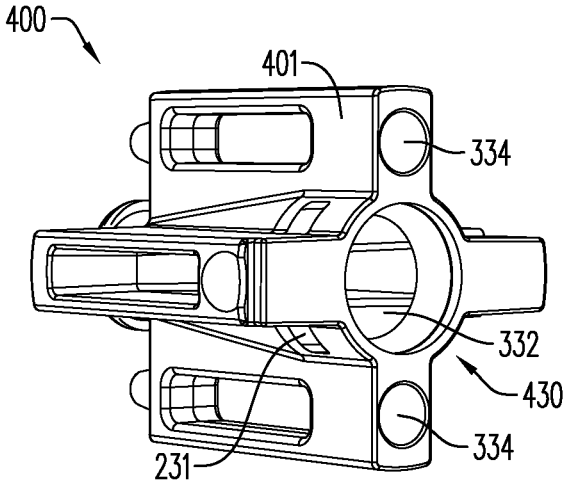
FIG. 5C shows a perspective view of the spacer of FIG. 5B.

With reference now to FIGS. 5A-5C, an exemplary spacer 400 may be used to overcome a desired distance or spacing between adjacent charge holders 300. According to an aspect, the spacer 400 may be configured for use when a lower shot density is desired (such as, for example, 3 or 4 shots per foot of gun length). The exemplary spacer 400 includes, without limitation, a spacer body 401 with a t-shaped cross-section extending between a male connector end 435 and a female connector end 430. The male connector end 435 is configured substantially as the male connector end 335 of the exemplary shaped charge holder 300 and the female connector end 430 is configured substantially as the female connector end 230 of the body 210 of the detonator holder 200. For example, the male connector end 435 includes a bifurcated knob connector 322 for connecting to a centrally arranged hole 332 on a female connector end 330, 430 of an adjacent component such as a charge holder 300, another spacer 400, or a detonator holder 200. Similarly, the female connector end 430 of the spacer includes a centrally arranged hole 332 and phasing holes 334 for connecting to a knob connector 322 and phasing protrusions 324 on a male connector end 335, 435 of an adjacent component such as a charge holder 300 or another spacer 400. In an aspect, an inner portion circumscribing the centrally arranged hole 332 of the female connector end 430 may include an inner rim 420 against which the positive locking mechanism of the knob connector 322 of an adjacent charge holder 300 or spacer 400 may engage.

According to an aspect, the spacer 400 may facilitate a set phasing between shaped charge holders 300 to which the spacer 400 (or spacers) is connected. For example, the phasing protrusions 324 and phasing holes 334 on the respective male connector end 435 and female connector end 430 of the spacer 400 will be oriented according to the same phasing of the charge holders to which they are attached and dictated by the orientation of the corresponding connectors on the charge holders, thereby maintaining the phasing of the charge holders while spacing them apart. The spacer 400 may further include a positive undercut 231 such as a slot to facilitate a locking action for the spacer 400 to be secured to the shaped charge holder 300 in a manner similar to the undercut area 231 of the detonator holder 200 illustrated in FIG. 3A and described hereinabove.

The exemplary connectors, including the knob connector 322, phasing protrusions 324, phasing holes 334, and centrally arranged hole 332, may provide a more secure, standardized, economical, and useful connection between modular perforating gun assembly components. For example, the connection between the knob connector 322 and the centrally arranged hole 332 is robust enough on its own to secure the connection between components. Accordingly, the phasing protrusions 324 need only set in the phasing holes 334 to establish the desired phasing and not to support the connection between the components. Accordingly, the phasing protrusions 324 may be funnel shaped or otherwise have a simple geometry that does not include fine surface features such as "mushroom-tops" for separately providing positive locking mechanisms.

Further, as discussed with respect to the spacer 400 and the charge holders 300, the connections between these and other components of the modular perforating gun assembly may be standardized such that components may be arranged in any desired order while maintaining a desired phasing of shaped charges 320. Each set of phasing holes 334 may be positioned specifically corresponding to a particular phasing, and gaps between the respective phasing holes help to show the correct phasing to which the components are being assembled.

With reference now to FIGS. 4H-4L, when a detonating cord 140 is routed, for example along path 'a', between charge holders 300 at a relatively high degree of phasing, the forces acting on the detonating cord 140 at the retention socket 350 tend to force the detonating cord 140 away from an initiation point of the shaped charge 320, either to the side of the initiation point or away from initiation point in a direction such that the detonating cord 140 is pulling away from the retention socket 350. In either case, this can cause failed detonation of the shaped charge 320 because the detonating cord 140 must be held precisely above the initiation point, to detonate the shaped charge 320. Typical detonating cord retaining structures lose their securing force against the detonating cord as the phasing of charge holders increases.

With continuing reference to FIGS. 4H-4L, an exemplary embodiment of a retention socket 350 with oppositely disposed retention arms 353 that form a detonating cord receptacle 351 is configured to increase the locking force on the detonating cord 140 as the phasing of the charge holders 300 increases. Each oppositely disposed retention arm 353 includes a shaped sidewall portion 357 and a corresponding flange 359 extending transversely from a top section of the retention arm 353. Each shaped sidewall portion 357 is adapted to abut against the detonating cord 140 when the detonating cord 140 is routed through the detonating cord receptacle 351. The shaped sidewall portions 357 may be resilient and counteract forces exerted by the detonating cord 140 on one or both of the shaped sidewall portions 357, thereby preventing side-to-side movement of the detonating cord 140 and locking the detonating cord 140 in place above the initiation point of the shaped charge 320.

In an aspect, the shaped sidewall portions 357 may have respective concavely curved sections which face each other to form the detonating cord receptacle 351. The concavely curved sections conform to and retain the cylindrically shaped detonating cord 140 and increase the surface area of the shaped sidewall portions 357 engaging the detonating cord 140. An underside of each of the flanges 359 follows the concave curvature of the shaped sidewall portions 357 to similarly accept and retain the detonating cord 140. Accordingly, as the phasing between successive charge holders 300 increases and the detonating cord 140 must route through the retention mechanism 350 at a more drastic angle, the amount and strength of contact between the detonating cord 140 and the resilient shaped sidewall portions 357 is increased and the degree of movement of the detonating cord 140 within the detonating cord receptacle 351 is decreased.

The flanges 359 extend from opposite sides of the retention arms 353 and each flange 359 extends beyond the shaped sidewall portion 357 of the corresponding retention arm 353 to form an overhang under which the detonating cord 140 may pass. Accordingly, the detonating cord 140 is held down, i.e., against the base portion 336 of the charge holder 300 within the detonating cord receptacle 351, by one or both of the flanges 359 on either side of the detonating cord receptacle 351 and within the detonating cord receptacle 351.

In another aspect, the shaped sidewall portions 357 each have a beveled edge section 355 underneath the corresponding flange 359. The beveled edge section 355 provides a smooth surface against which the detonating cord 140 may abut when taking sharper angles through the retention socket 350 at higher phasing. The beveled edge section 355 may distribute the force that the detonating cord 140 exerts on the retention arm 353 and provide an additional conforming connection between the retention arm 353 and the detonating cord 140.

Figure 4L:
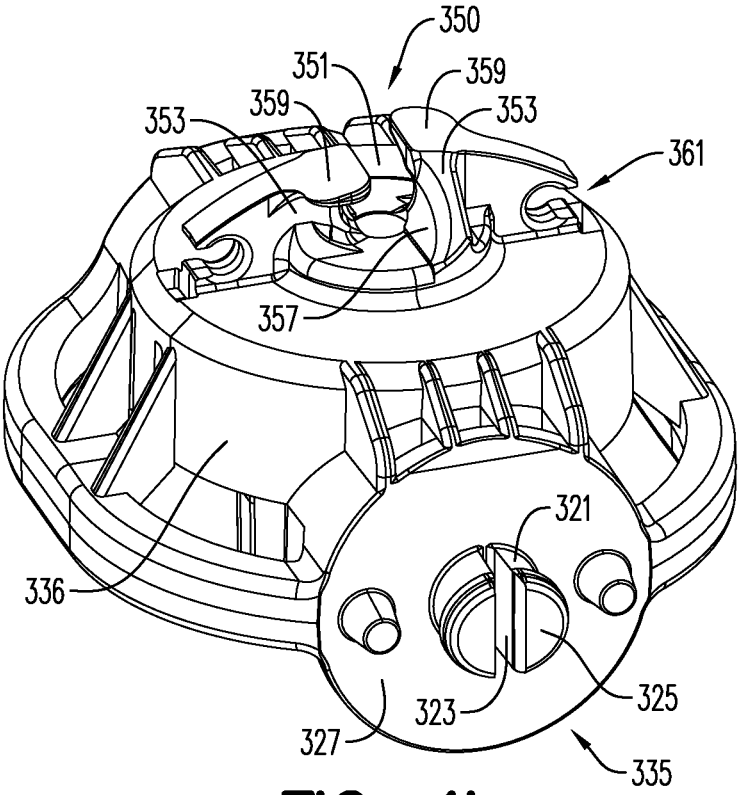
FIG. 4L shows a perspective view of the shaped charge holder and retention socket of FIG. 4K.

In a further aspect, as shown in FIG. 4L, the exemplary retention socket 350 may include a through wire retention socket 361 for receiving and retaining the through wire 160.

The exemplary retention socket 350 shown in FIGS. 4H-4L may be formed by injection molding as an integral surface feature of the base portion 336 of the charge holder 300. Accordingly, the manufacturing process may be more efficient for the exemplary retention socket shown in FIGS. 4H-4L than for typical clip-style detonating cord retainers.

The exemplary perforating gun assembly 100 may also route, e.g., the detonating cord 140 and the through wire 160 through the perforating gun assembly 100 in a manner that prevents the detonating cord 140 and the through wire 160 (and/or other cords or wires that may be present in particular applications) from being twisted or crimped. For example, each of the detonator holder 200, the shaped charge holder 300, and the cord terminator 500 are equipped with structures to route the detonating cord 140 and through wire 160 to remove or substantially reduce strain, excessive bending and stress on the detonating cord 140 and the through wire 160. In an aspect, each of these structures are located on external surfaces of the detonator holder 200, the shaped charge holder 300, and the cord terminator 502—for example, the detonating cord chamber 240, the retention socket 350, and the detonating cord terminator 502—to aid in the assembly process of the perforating gun components, because the detonating cord 140 and the through wire 160 may be installed last and inserted into place at each component from the outside of each component. These structures/routing mechanisms eliminate the need to, e.g., wrap cords around components of the perforating gun assembly 100 as the components of the perforating gun assembly 100 are being assembled. This reduces mechanical stress/force being imparted on the cords and wires of the assembly and reduces potential waste caused by excessive cord length.

Figure 6A:
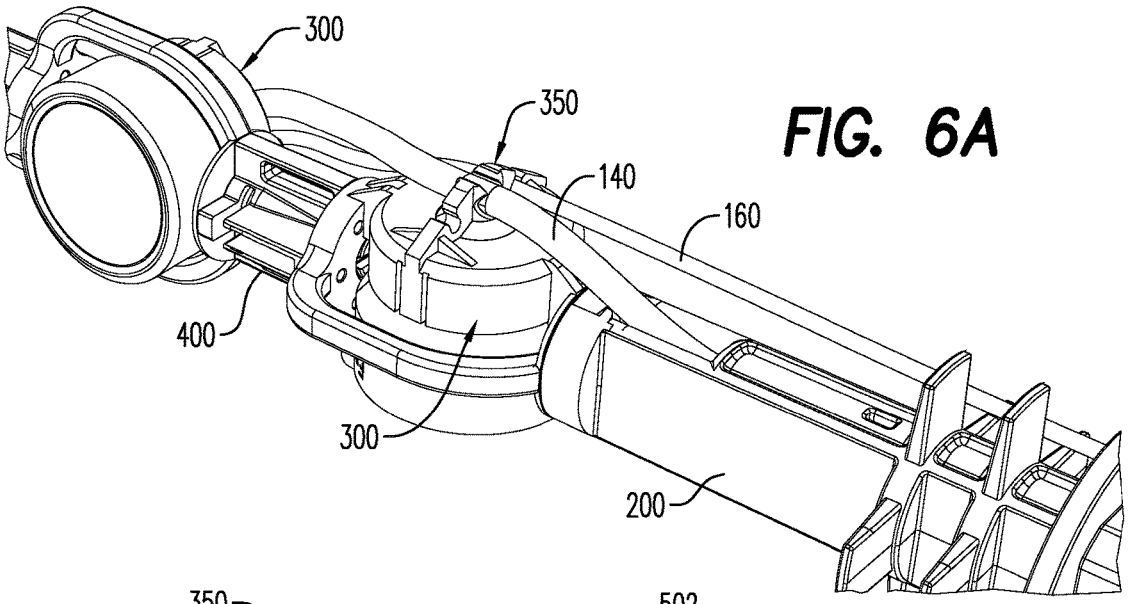
FIG. 6A shows a portion of a modular perforating gun assembly, according to an exemplary embodiment.
Figure 6B:
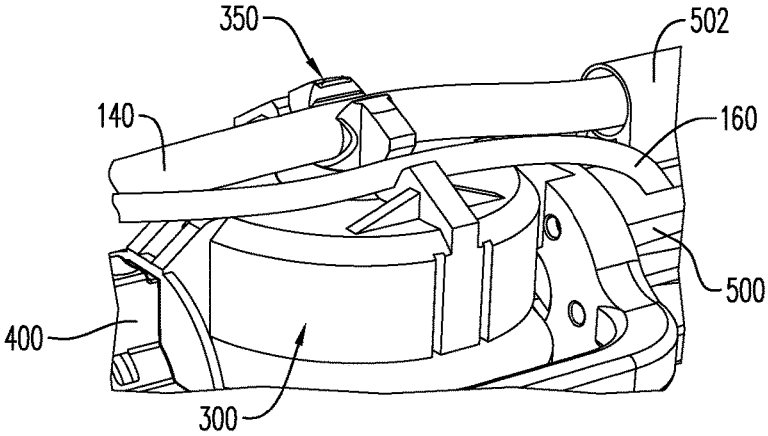
FIG. 6B shows a shaped charge holder in a portion of a modular perforating gun assembly, according to an exemplary embodiment.
Figure 6C:
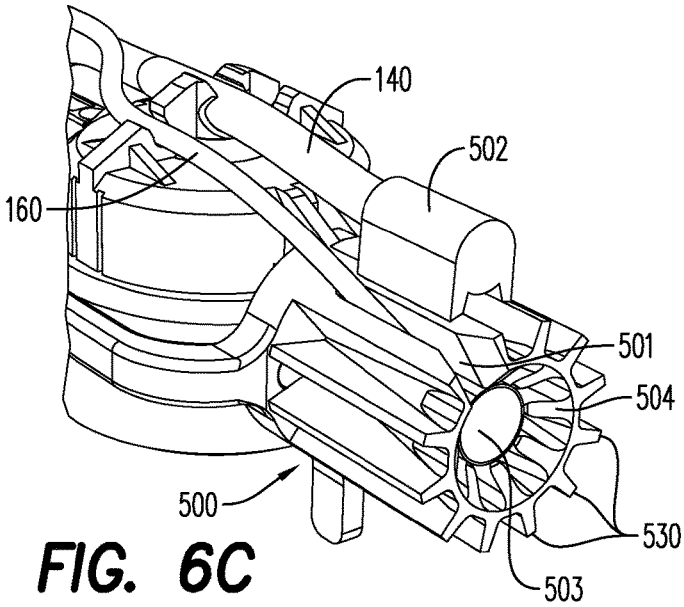
FIG. 6C shows a cord terminator in a portion of a modular perforating gun assembly, according to an exemplary embodiment.
Figure 7:
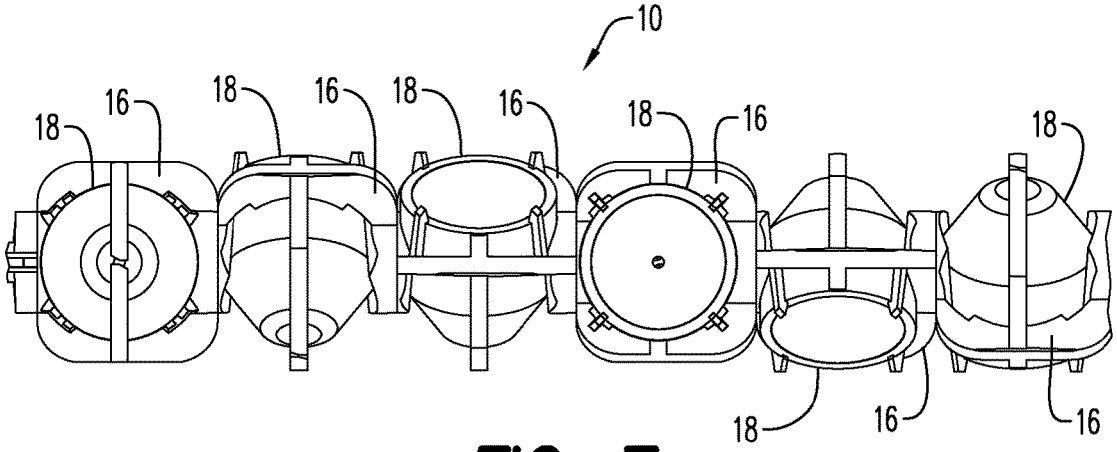
FIG. 7 (PRIOR ART)
FIG. 7 shows an assembly of shaped charge holders, according to the prior art.
Figure 8:
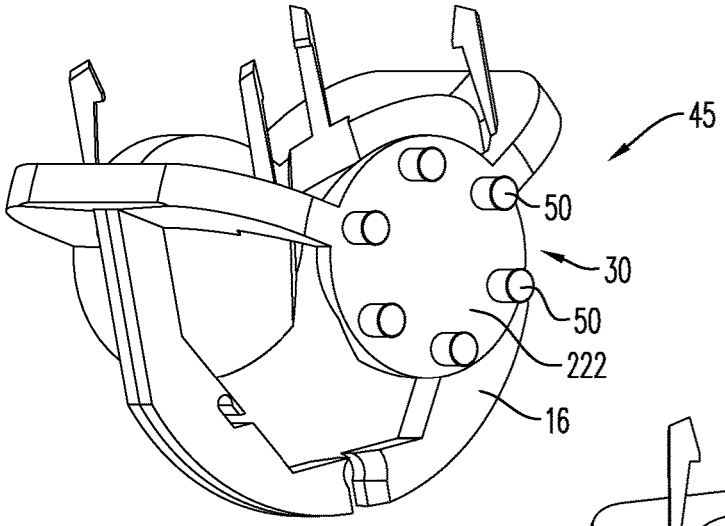
FIG. 8 (PRIOR ART)
FIG. 8 shows a perspective view of a shaped charge holder, according to the prior art.
Figure 9:
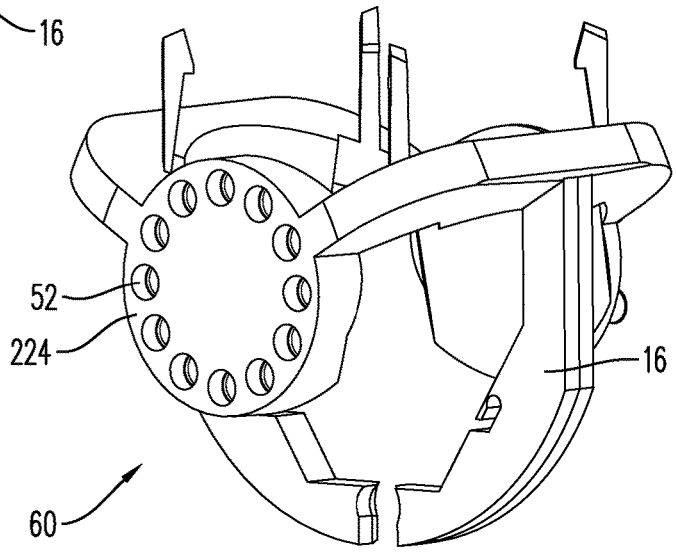
FIG. 9 (PRIOR ART)
FIG. 9 shows a perspective view of a shaped charge holder, according to the prior art.

As shown in FIGS. 6A, 6B and 6C, for example, the exemplary perforating gun assembly 100 includes the detonating cord 140 and the through wire 160. The detonating cord 140 extends from the detonator holder 200 (FIG. 6A) to the shaped charge holder 300 (FIGS. 6A, 6B and 6C), optionally to the spacer 400 and/or other shaped charge holders 300, and then to the detonating cord terminator 502 in the cord terminator 500 (FIGS. 6B and 6C). The first end of the detonating cord 140 and the first end of the through wire 160 are secured in the detonator holder 200, while the second ends are secured in the cord terminator 500. The detonating cord terminator 502 positively seals and terminates the detonating cord 140 and does not apply any additional stress/bending to the cord. As illustrated in FIG. 6C, the second end of the detonating cord 140 is terminated in a receiving chamber (not illustrated) within the detonating cord terminator 502. The cord terminator 500 may further include a cylindrical body 504 with contours/fins 530 to reduce the volume of the injection molding material required during manufacturing and increase the stability of the cord terminator 500. According to an aspect, in certain embodiments the cord terminator 500 may include one or more male connector elements, such as the centrally oriented knob connector 322 and the at least one phasing protrusion 324 of the shaped charge holder 300, for connecting to other components.

Certain benefits of the disclosed embodiments may include, but are not limited to: 1) running slimmer guns in smaller casings; 2) perforating through two casing strings; 3) high performance; 4) can be manufactured at a low cost; 5) performance optimization through maximum charge size and configuration; 6) future proof for automatic assembly; 7) less raw material use; 8) more robust assembly—self supporting; 9) universal charge fixation.

In further aspects of the disclosure:

The detonating cord is routed in a spiral fashion from the charge holder 300 to a first or second component which has a phasing of greater than zero degrees with respect to the charge holder 300.

A positive locking occurs upon engagement between the male connector end 335 of one charge holder and the female connector end 330 of a further charge holder.

The knob connector 322 extends away from a face 327 of the male connector end 335 a further distance than does the at least one phasing protrusion 324.

The knob connector 322 comprises the cylindrical extension 321 with the end face 325, the end face 325 having a larger diameter than the cylindrical extension 321.

The end face 325 and at least a portion of the cylindrical extension 321 adjacent the end face 325 is resilient and bifurcated by a slit 323, and the slit 323 enables compression of the cylindrical extension 321 for insertion into the central bore 332 of the female connector end 330 and expansion of the cylindrical extension 321 upon insertion into the central bore 332. A positive locking between the male connector end 335 and the female connector end 330 occurs as an underside of the end face 325 engages with an inner rim 337 of the central bore 332.

The phasing holes 334 are arranged to facilitate 0-, 60-, 90-, 120-, and 180-degree phasing of the shaped charge receiving portion 310 when two or more charge holders are connected together.

The shaped charge receiving portion 310 is configured as an opening defined by one or more arms 312 and the complimentary depression in the base portion 336, and the one or more arms connect between the male connector end 335 and the female connector end 330.

The stackable charge holder 300 includes the locking mechanism 333 for the shaped charge formed in the shaped charge receiving portion 310.

The female connector end 230 of the detonator holder 200 comprises a positive undercut 231 adapted to accept a portion of the knob connector 322 of a component such as a charge holder, enabling a locking connection between the detonator holder and the component.

The positive undercut 231 is formed as a chamfer at an end of the chamber 240 adjacent the female connector end 230.

This disclosure, in various embodiments, configurations and aspects, includes components, methods, processes, systems, and/or apparatuses as depicted and described herein, including various embodiments, sub-combinations, and subsets thereof. This disclosure contemplates, in various embodiments, configurations and aspects, the actual or optional use or inclusion of, e.g., components or processes as may be well-known or understood in the art and consistent with this disclosure though not depicted and/or described herein.

The phrases "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

In this specification and the claims that follow, reference will be made to a number of terms that have the following meanings. The terms "a" (or "an") and "the" refer to one or more of that entity, thereby including plural referents unless the context clearly dictates otherwise. As such, the terms "a" (or "an"), "one or more" and "at least one" can be used interchangeably herein. Furthermore, references to "one embodiment", "some embodiments", "an embodiment" and the like are not intended to be interpreted as excluding the existence of additional embodiments that also incorporate the recited features. Approximating language, as used herein throughout the specification and claims, may be applied to modify any quantitative representation that could permissibly vary without resulting in a change in the basic function to which it is related. Accordingly, a value modified by a term such as "about" is not to be limited to the precise value specified. In some instances, the approximating language may correspond to the precision of an instrument for measuring the value. Terms such as "first," "second," "upper," "lower" etc. are used to identify one element from another, and unless otherwise specified are not meant to refer to a particular order or number of elements.

As used herein, the terms "may" and "may be" indicate a possibility of an occurrence within a set of circumstances; a possession of a specified property, characteristic or function; and/or qualify another verb by expressing one or more of an ability, capability, or possibility associated with the qualified verb. Accordingly, usage of "may" and "may be" indicates that a modified term is apparently appropriate, capable, or suitable for an indicated capacity, function, or usage, while taking into account that in some circumstances the modified term may sometimes not be appropriate, capable, or suitable. For example, in some circumstances an event or capacity can be expected, while in other circumstances the event or capacity cannot occur—this distinction is captured by the terms "may" and "may be."

As used in the claims, the word "comprises" and its grammatical variants logically also subtend and include phrases of varying and differing extent such as for example, but not limited thereto, "consisting essentially of" and "consisting of." Where necessary, ranges have been supplied, and those ranges are inclusive of all sub-ranges therebetween. It is to be expected that the appended claims should cover variations in the ranges except where this disclosure makes clear the use of a particular range in certain embodiments.

The terms "determine", "calculate" and "compute," and variations thereof, as used herein, are used interchangeably and include any type of methodology, process, mathematical operation or technique.

This disclosure is presented for purposes of illustration and description. This disclosure is not limited to the form or forms disclosed herein. In the Detailed Description of this disclosure, for example, various features of some exemplary embodiments are grouped together to representatively describe those and other contemplated embodiments, configurations, and aspects, to the extent that including in this disclosure a description of every potential embodiment, variant, and combination of features is not feasible. Thus, the features of the disclosed embodiments, configurations, and aspects may be combined in alternate embodiments, configurations, and aspects not expressly discussed above. For example, the features recited in the following claims lie in less than all features of a single disclosed embodiment, configuration, or aspect. Thus, the following claims are hereby incorporated into this Detailed Description, with each claim standing on its own as a separate embodiment of this disclosure.

Advances in science and technology may provide variations that are not necessarily express in the terminology of this disclosure although the claims would not necessarily exclude these variations.

What is claimed is:

1. A modular, stackable charge holder for a perforating gun assembly, comprising:

a base portion;

a shaped charge receiving portion formed in the base portion for receiving a shaped charge;

a retention socket extending from the base portion adapted to receive and retain a detonating cord;

a male connector end arranged on one side of the base portion for receiving a corresponding female connector end of a first component;

a female connector end arranged on a second side of the base portion opposite the first side of the base portion for receiving a corresponding male connector end of a second component;

wherein:

the retention socket comprises oppositely disposed retention arms that form a receptacle for the detonating cord, each oppositely disposed retention arm having at least one corresponding shaped sidewall portion and a corresponding flange extending transversely from a top section of the retention arm;

the shaped sidewall portions are adapted to abut against the detonating cord when the detonating cord is routed from the charge holder to at least one of the first or second component;

the shaped sidewall portions are resilient and counteract forces exerted by the detonating cord on one or both of the sidewall portions, locking the detonating cord in place, wherein:

the male connector end comprises a centrally oriented knob connector and at least one phasing protrusion spaced apart from the knob connector;

the female connector end comprises a central bore and a plurality of spaced-apart phasing holes surrounding the central bore; and the male connector end is adapted to interconnect with the female connector end of the first or second component at various phase angles corresponding to the phasing holes.

2. A modular, stackable charge holder in accordance with claim 1, wherein the detonating cord is routed in a spiral fashion from the charge holder to the at least one of the first or second further component which has a phasing of greater than zero degrees with respect to the charge holder.

3. A modular, stackable charge holder in accordance with claim 1, wherein a positive locking occurs upon engagement between the male connector end of one charge holder and the female connector end of a further charge holder.

4. A modular, stackable charge holder in accordance with claim 3, wherein the knob connector comprises a cylindrical extension with an end face, the end face having a larger diameter than the cylindrical extension.

5. A modular, stackable charge holder in accordance with claim 4, wherein:

the end face and at least a portion of the cylindrical extension adjacent the end face is resilient and bifurcated by a slit;

the slit enables compression of the cylindrical extension for insertion into the central bore of the female connector end and expansion of the cylindrical extension upon insertion into the central bore;

after insertion, a positive locking between the male connector end and the female connector end occurs as an underside of the end face engages with an inner rim of the central bore.

6. A modular, stackable charge holder in accordance with claim 3, wherein the at least one phasing protrusion is funnel-shaped.

7. A modular, stackable charge holder in accordance with claim 1, wherein the knob connector extends away from a face of the male connector end a further distance than does the at least one phasing protrusion.

8. A modular, stackable charge holder in accordance with claim 1, wherein the shaped sidewall portions each have concavely curved sections which face each other to form the receptacle.

9. A modular, stackable charge holder in accordance with claim 1, wherein:

the corresponding flanges extend from opposite sides of the retention arms;

an underside of each of the flanges is concavely curved to accept the detonating cord; and the shaped sidewall portions each have a beveled edge section underneath the corresponding flange.

10. A modular, stackable charge holder in accordance with claim 1, further comprising at least one additional retention socket adapted to receive and retain a through wire.

11. A modular, stackable charge holder in accordance with claim 1, wherein the charge holder is produced in one piece via injection molding.

12. A modular, stackable charge holder in accordance with claim 1, wherein:

the shaped charge receiving portion is configured as an opening defined by one or more arms and a complimentary depression in the base portion; and the one or more arms connect between the male connector end and the female connector end.

13. A modular, stackable charge holder in accordance with claim 1, further comprising a locking mechanism for the shaped charge formed in the shaped charge receiving portion.

14. A connector system for connecting components of a perforating gun assembly, comprising:

a male connector end arranged on a first side of a first component;

a female connector end arranged on a first side of a second component adapted to positively connect to the male connector end of the first component;

wherein:

the male connector end comprises a centrally oriented knob connector and at least one phasing protrusion spaced apart from the knob connector;

the female connector end comprises a central bore and a plurality of spaced-apart phasing holes surrounding the central bore; and the male connector end of the first component is adapted to interconnect with the female connector end of the second component at various phase angles corresponding to the phasing holes.

15. The connector system in accordance with claim 14, wherein the knob connector extends away from a face of the male connector end a further distance than does the at least one phasing protrusion.

16. The connector system in accordance with claim 14, wherein the knob connector comprises a cylindrical extension with an end face the end face having a larger diameter than the cylindrical extension.

17. The connector system in accordance with claim 16, wherein:

the end face and at least a portion of the cylindrical extension adjacent the end face is resilient and bifurcated by a slit;

the slit enables compression of the cylindrical extension for insertion into the central bore of the female connector end and expansion of the cylindrical extension upon insertion into the central bore; and after insertion, a positive locking between the male connector end and the female connector end as an underside of the end face engages with an inner rim of the central bore.

18. A modular perforation gun assembly, comprising:

a housing;

a detonating cord;

a first modular component comprising a detonator holder;

at least one second modular component comprising at least one stackable charge holder connected at a first end to the detonator holder, each of the at least one stackable charge holders adapted for centralizing a shaped charge within the housing;

a third modular component comprising a cord terminator connected to a second end of the at least one stackable charge holder for terminating the detonating cord;

a connector system for connecting the modular components of a perforating gun assembly, the connector system comprising:

a male connector end and a female connector end adapted to positively connect to the male connector end;

wherein:

each of the modular components comprises at least one of the male connector end and the female connector end;

the male connector end comprises a centrally oriented knob connector and at least one phasing protrusion spaced apart from the knob connector;

the female connector end comprises a central bore and a plurality of spaced-apart phasing holes surrounding the central bore; and the male connector end of the first component is adapted to interconnect with the female connector end of the second component at various phase angles corresponding to the phasing holes.

19. The modular perforation gun assembly in accordance with claim 18, wherein the phasing holes are arranged to facilitate 0-, 60-, 90-, 120-, and 180-degree phasing between the first and second modular components when connected together.

* * * * *